US007255758B2

(12) United States Patent
Kawabe et al.

(10) Patent No.: US 7,255,758 B2
(45) **Date of Patent: *Aug. 14, 2007**

(54) STEEL WIRE AND METHOD OF MANUFACTURING THE SAME

(75) Inventors: Nozomu Kawabe, Hyogo (JP); Teruyuki Murai, Hyogo (JP); Koji Yamaguchi, Hyogo (JP); Yukihiro Oishi, Hyogo (JP)

(73) Assignee: Sumitomo Electric Industries, Ltd., Osaka (JP)

( * ) Notice: Subject to any disclaimer, the term of this patent is extended or adjusted under 35 U.S.C. 154(b) by 365 days.

This patent is subject to a terminal disclaimer.

(21) Appl. No.: 10/361,619

(22) Filed: Feb. 11, 2003

(65) Prior Publication Data

US 2003/0168136 A1 Sep. 11, 2003

Related U.S. Application Data

(62) Division of application No. 09/486,370, filed as application No. PCT/JP98/03622 on Aug. 13, 1998, now Pat. No. 6,527,883.

(30) Foreign Application Priority Data

| | | |
|---|---|---|
| Aug. 28, 1997 | (JP) | 9-249335 |
| Nov. 13, 1997 | (JP) | 9-331273 |
| Nov. 19, 1997 | (JP) | 9-336335 |
| Mar. 31, 1998 | (JP) | 10-105836 |

(51) Int. Cl.
*C21D 9/02* (2006.01)
*C21D 9/52* (2006.01)

(52) U.S. Cl. ..... 148/580; 148/595; 148/598; 148/599

(58) Field of Classification Search ..... 72/274–291; 148/580, 595, 598, 599
See application file for complete search history.

(56) References Cited

U.S. PATENT DOCUMENTS 4,759,806 A 7/1988 Dambre (Continued)

FOREIGN PATENT DOCUMENTS

EP 0 218 167 4/1987

(Continued)

OTHER PUBLICATIONS

"Metals Handbook: vol. 14 Forming and Forging", ASM International, 1988, p. 330-333.*

*Primary Examiner*—Roy King
*Assistant Examiner*—Janelle Morillo
(74) *Attorney, Agent, or Firm*—McDermott Will & Emery LLP

(57) ABSTRACT

A steel wire of pearlite structure containing 0.8-1.0 mass % of C and 0.8-1.5 mass % of Si is disclosed. In the cross section of the steel wire the difference in average hardness between a region up to 100 μm from the surface thereof and a deeper region is within 50 in micro-Vickers hardness. The steel wire is manufactured by working a wire rod having the abovementioned chemical composition through shaving, patenting and drawing processes, then strain-relief annealing the resultant wire, and thereafter subjecting the thus annealed to a shot peening process. The steel wire has a high heat resistance and a high fatigue strength, and can be produced through a drawing process without applying a quenching and tempering process.

3 Claims, 29 Drawing Sheets

U.S. PATENT DOCUMENTS

| | | | | |
|---|---|---|---|---|
| 4,889,567 | A * | 12/1989 | Fujiwara et al. | 148/598 |
| 5,277,048 | A * | 1/1994 | Lubas | 72/53 |
| 5,904,830 | A * | 5/1999 | Yamao et al. | 205/640 |
| 6,627,005 | B1 * | 9/2003 | Kawabe et al. | 148/226 |

FOREIGN PATENT DOCUMENTS

| | | | |
|---|---|---|---|
| EP | 218167 | A1 * | 4/1987 |
| EP | 0 761 825 | A2 | 3/1997 |
| JP | 55-113839 | | 9/1980 |
| JP | 57-047835 | A | 3/1982 |
| JP | 57-140833 | | 8/1982 |
| JP | 60-002631 | | 1/1985 |
| JP | 62-77418 | | 4/1987 |
| JP | 62-77442 | | 4/1987 |
| JP | 7-305285 | | 11/1995 |
| JP | 8-120407 | | 5/1996 |
| JP | 8-170150 | | 7/1996 |
| JP | 8-170151 | | 7/1996 |
| JP | 8-232046 | | 9/1996 |
| JP | 08260097 | A * | 10/1996 |
| JP | 9-118957 | | 5/1997 |
| JP | 9-194994 | | 7/1997 |

* cited by examiner 0.1μm

STEEL WIRE AND METHOD OF MANUFACTURING THE SAME

This application is a divisional of application Ser. No. 09/486,370 now U.S. Pat. 6,527,883 filed Feb. 28, 2000, which is a 371 application of PCT/JP98/03622, filed Aug. 13, 1998.

TECHNICAL FIELD

The present invention relates to a steel wire having a high fatigue strength best suited to spring, PC steel wire and so on, and to a method of manufacturing such a steel wire. More specially, the invention relates to such a steel wire having an excellent heat resistance or delayed fracture properties as well and to a method of manufacturing such a steel wire.

BACKGROUND ART

Spring steel wires containing 0.6-0.8 mass % of C, 0.15-0.35 mass % of Si, and 0.3-0.9 mass % of Mn are known in the art. Such a steel wire is manufactured by being processed through steps of rolling→patenting (heating for γ-phase transition→isothermal transformation)→wire drawing→(coiling)→strain relief annealing (for example, at 300±30° C.).

However, it is a well-known fact that such a type of steel wire obtained by drawing a pearlite steel (generally called a piano wire or hard drawn steel wire: hereinafter shall be generically referred to as a piano wire) has a relatively low heat resistance.

Therefore, in high temperature environments where a permanent set resistance is required, quenched and tempered steel wires such as heat-resistant piano wires having a high Si content and oil tempered wires of Si—Cr steel (hereinafter shall be referred to as OT wire) have been used. Working environments requiring a heat resistance include a case of galvanizing a steel wire, for example, and it is customary to add Si to the steel in order to prevent or retard a decrease in strength in the course of the galvanization process.

In addition, it has been proposed that a steel wire having a high strength and toughness can be obtained by finely dividing cementite into microcrystals of a nano-order size. (Japanese Provisional Publication NO. 120407/96.)

However, the aforementioned prior arts have had a number of problems as follows:

(1) While important properties for steel wires include: a) high tensile strength, b) high toughness, and c) high fatigue strength, a high tensile strength is not necessarily compatible with a high fatigue strength in those steel wires to be processed through drawing. Generally, the tensile strength of a steel wire increases with its working ratio of drawing (reduction ratio). In addition, a fatigue strength cannot be increased without a comparatively high tensile strength. However, increasing the working ratio will result in increased micro defects of the material through plastic working, and such micro defects, when concentrated, will act as origins of earlier occurring fatigue fractures.

(2) A heat-resistant piano wire generally has a high Cr content and takes a longer time for its heat treatment (patenting), resulting in a lower productivity.

(3) The use of a heat-resistant piano wire as a steel wire to be galvanized or otherwise exposed to heat (at about 450° C. for about 30 seconds) is intended to limit or retard a decrease in strength, but not to provide a thermal permanent set resistance at about 200° C. or so. It is known in a parallel wire and the like steel wires that heat resistance is improved by increasing the Si content. In this respect, however, the purpose of using steel wires having a good heat resistance varies with their specific uses, the heat resistance for the case of parallel wire fundamentally aims at limiting the change in tensile strength of the wire small when subjected to galvanization. On the other hand, in the case of automobile engine valve springs exposed to intense heat in operation or automobile torsion bars heated to at about 200° C. when car bodies are bake-finished, important considerations include keeping the permanent set in the temperature range of about 100-200° C. small and at the same time providing desired fatigue properties. Thus, simply applying a chemical composition of such a parallel wire to a spring wire cannot bring forth satisfactory properties sufficient for a spring material. That is to say, while the Si addition in a parallel wire is reportedly said to be effective in improving its fatigue properties, this is mere a story of fatigue under repeated tension, which differs essentially from the fatigue properties required for a spring material. A decrease in surface hardness greatly affects the fatigue properties in a spring steel wire having a high Si content, although its influence on the fatigue properties is small in a parallel wire.

(4) As for a heat-resistant piano wire, even the delayed fracture properties important for a spring are not usually taken into consideration. Steel wire may sometimes be subjected to cationic coating and the like processing for an anticorrosion purpose, and delayed fracture may be caused then if hydrogen gets into it the steel wire. Especially, in a spring steel wire, delayed fracture properties to torsion stress are important, but such delayed fracture properties has hardly been taken account of so far.

(5) OT wire is expensive. While a steel wire superior in both heat resistance and fatigue strength can be obtained by applying quenching and tempering in the final stage of the steel wire manufacture, such a quenching and tempering process adds to the cost.

Accordingly, an object of the present invention is to provide a steel wire having a high heat resistance (particularly at around 200° C.) and a high fatigue strength that can be produced without applying a quenching and tempering process, namely, produced through a drawing process and a method of manufacturing such a steel wire.

Another object of the present invention is to provide a steel wire having superior delayed fracture properties in addition to the heat resistance.

A further object of the present invention is to provide a steel wire having superior fatigue properties that can be achieved by improving its material strength and at the same time by optimally minimizing the origins of fatigue fracture and a method of manufacturing such a steel wire.

DISCLOSURE OF THE INVENTION

The present invention comprises the following features [1], [2], [3] and [4]:

[1] The present invention provides a steel wire comprising a pearlite structure containing 0.7-1.0 mass % of C and 0.5-1.5 mass % of Si, wherein in the cross section of the steel wire the difference in average hardness between a region up to 50 μm from the surface thereof and a more deeper region is within 50 in micro-Vickers hardness. This steel wire has a high heat resistance and fatigue strength, and is particularly suited for spring steel wire.

Preferably, the steel wire may further contain 0.03-0.1 mass % of Mo. Further, it may contain 0.3-0.9 mass % or less Mn and/or 0.2 mass % or less Cr. For providing a sufficient fatigue strength, this steel wire preferably has a tensile strength above 1800 N/mm$^2$.

Here, it is desirable that in the metal structure of the above steel wire the proeutectoid (granular) ferrite content is below 5 vol. %. Further, as to the shape of cementite particles constituting the pearlite structure, it is desirable that at least 80 vol. % of the cementite particles satisfy the following formula (1):

$$L/t \geqq 5 \quad (1)$$

where t is the thickness and L is the length of the cementite particles.

Requirements for achieving such metal structures are that given the following formula (2):

$$10\times(C(\text{mass }\%)-0.76)-Si(\text{mass }\%)+5\times Cr(\text{mass }\%)=T \quad (2)$$

the cooling rate V (° C./sec.) after heating for γ-phase transition satisfy the following formula (3) in the temperature range of 580° C. or above:

$$V \geqq -50T+275 \quad (3)$$

Further, a method of manufacturing the steel wire according to the present invention is characterized by comprising the steps of: shaving a steel wire of pearlite structure containing 0.7-1.0 mass % of C and 0.5-1.5 mass % of Si, patenting the resultant steel wire, and drawing the patented steel wire. This method of manufacture can produce the steel wire of the present invention without resorting to a quenching and tempering process, and can produce a steel wire having a high heat resistance and fatigue strength at low cost. Further, it is preferable to process the resultant drawn steel wire through a strain relief annealing in 350-450° C. In this connection, the working ratio of drawing may preferably be kept above 80%.

Hereinafter, the aforementioned features of the present invention will be discussed further in detail.

Chemical Composition

C: The lower limit of the C content was determined based on the fatigue strength, while its upper limit was determined based on the wire drawability.

Si: Si is a chemical element essentially required for improvement of heat resistance. With its content lower than the previously mentioned lower limit no sufficient heat resistance will be achieved, while the resultant steel wire become susceptible to surface flaws if the Si content is higher than its upper limit.

Mo: With an Mo content lower than its lower limit described above it will have a smaller effect on the improvement in the heat resistance and fatigue strength of the steel wire, while its content exceeding the upper limit will elongate the time required for patenting, resulting in a lowered productivity.

Mn: Mn is added for improving the quench hardenability of steel wire. Mn content exceeding the upper limit tends to increase segregation and lowers wire drawability.

Cr: The aforementioned upper limit was determined, because a longer patenting time become required when the Cr content exceeded that level.

Shaving

A purpose of the shaving process is to remove a low hardness layer on the surface of steel wire. The fatigue properties are improved by removing those outer layers having a micro-Vickers hardness at least 50 lower than that of the inner portion of steel wire.

Strain Relief Annealing

The strain relief annealing process is applied at 350-450° C. for improving the fatigue properties of spring. An annealing temperature below the lower limit has only a little effect on fatigue properties improvement, the strength and fatigue strength of wire both decrease if the annealing temperature exceeds its upper limit. A preferable annealing time may be about 20 minutes in view of effects and productivity.

Proeutectoid Ferrite

A steel material having a high Si content as in the steel wire according to the present invention has a characteristic of tending to cause proeutectoid ferrite precipitation, which adversely affects on the fatigue properties of steel wire. Keeping the proeutectoid ferrite content below 5 vol. % is effective in improving greatly the fatigue properties and heat resistance of steel wire.

Cementite Morphology

The shape of cementite particles also has an important on the fatigue properties and heat resistance of steel wire. This is because unlike the heat resistance at 450° C. or above in the prior art parallel wire a satisfaction of the foregoing formula (1) is desirable for sufficient fatigue properties and heat resistance in the temperature range of 100-200° C. according to the present invention.

Relation between Chemical Composition and Cooling Rate

The aforementioned relation between the chemical composition and the cooling rate after heating for γ-phase transition satisfying the foregoing formulas (2) and (3) is required because a steel wire having a metal structure that satisfy the aforementioned requirements for proeutectoid ferrite and cementite particle shape.

[2] Further, the present invention provides a steel wire comprising a pearlite structure plastically worked and containing 0.75-1.0 mass % of C and 0.5-1.5 mass % of Si, wherein cementite particles with the size of 5-20 nm in width are arranged substantially alternately with cementite particles with the size of 20-100 nm in width, said cementite particles of said two different width ranges both having a thickness of 5-20 nm. This steel wire, even if in the form of a piano wire, has at around 200° C. a heat resistance substantially equivalent to that of an OT wire. Therefore, it can be used for valve springs of automobile engines and the like.

This steel wire may further contain at least one of Mo and V in total content of 0.05-0.2 mass %, and may also further contain 0.01-0.03 mass % of Al.

Further, it is desired that semicircular stains would not be observed at the interfaces between ferrite and cementite particles as viewed on a transmission electron micrograph.

Furthermore, it is desired that the thickness A1 of cementite particles with the size of 20-100 nm in width and the thicknesswise length A2 of those portions of adjacent cementite particles with the size of 5-20 nm in width contacting the former cementite particles 20-100 nm wide satisfy a relation expressed by the following formula:

$$0.3<A2/A1<0.95$$

According to the present invention, the most suitable method to produce the steel wire just described above comprises plastically cold-working a steel wire material of containing 0.75-1.0 mass % of C, 0.5-1.5 mass % of Si so that a 0.7 or higher true strain is obtained, said step of plastically cold-working being at least one of drawing, rolling, roller die drawing and swaging, wherein the true strain in one cycle of cold working is kept in the range of 0.1-0.25, the direction of the steel wire is reversed front end rear in the course of working, and the resultant plastically cold-worked steel wire is subsequently heat-treated at 230-450° C. This method of manufacture can produce the steel wire according to the present invention having a high heat resistance at a low cost. More preferably, the torsion of the steel wire in the aforesaid plastically cold-working process may be kept within 15° per 100 mm of steel wire length.

Now, the aforementioned features of the present invention will be discussed further in detail.

C: 0.75-1.0 Mass %

With a C content lower than 0.75 mass %, the steel wire will have a low strength as well as a low heat resistance. While, with a C content exceeding 1.0 mass %, the plastic working will become difficult as the Si content is increased.

Si: 0.5-1.5 Mass %

With an Si content lower than 0.5 mass %, the steel wire will have a low heat resistance, while the plastic working will become difficult if the Si content exceeds 1.5 mass %.

Cementite Particles Shape and Size

If the conditions that cementite particles with the size of 5-20 nm in width are arranged substantially alternately with cementite particles with the size of 20-100 nm in width and that the cementite particles of said two different width ranges both have a thickness of 5-20 nm are not maintained, the heat resistance of the steel wire at up to about 200° C. will decrease.

Ferrite-Cementite Interfacial Strain

The heat resistance of steel wire will decrease remarkably if semicircular-stains are observed at the interfaces between ferrite and cementite particles.

State of Contact between Adjacent Cementite Particles

If the relation between the thickness A1 of cementite particles 20-100 nm wide and the thicknesswise length A2 of those portions of adjacent cementite particles 5-20 nm wide contacting adjacent the former cementite particles 20-100 nm wide falls outside the range defined by the formula: $0.3<A2/A1<0.95$, the steel wire will have a decreased heat resistance.

Total Mo and V Content of 0.05-0.2 Mass %

If the total content of Mo and V in the steel wire exceeds the above said rage, it will become difficult to obtain the pearlite structure. Specifically, It takes a longer time for transformation, resulting in a remarkable decrease in productivity.

Al: 0.01-0.03 Mass %

An Al content in the aforementioned range is effective in improving the toughness of the steel wire.

Cold Plastic Working

The toughness of steel wire will decrease if the true strain falls outside the range of 0.1-0.25. Further, reversing the direction of the steel wire in the course of working process can additionally improve the toughness the steel wire.

Torsion in Working

If the torsion of the steel wire in the aforementioned plastically cold-working process is kept within 15° per 100 mm of steel wire length, the heat resistance of the steel will be improved and the shape and size of cementite particles can be stablized.

[3] Further, the present invention provides a steel wire of pearlite structure containing 0.7-1.0 mass % of C, 0.5-1.5 mass % of Si and less than 0.2 mass % of Cr, wherein a relation given by the following formula (4) is satisfied at 250° C. or below:

$$\gamma \leq 0.00004 \times A - 0.035 + \left(\frac{(A-100)\times(B-450)}{750000}\right) + \left(\frac{0.015\times\log(C+1)}{1.38} - 0.015\right) \quad (4)$$

where γ is a residual shear strain (%), A represents a temperature (150° C. or above), B represents a shear stress (300 MPa or above), and C represents a time (0.1 hr. or longer), and wherein a relation given by the following formula (5) is satisfied:

$$T_{DF} > 200/\tau \quad (5)$$

where

τ: a shear stress of 200 MPa or above, $T_{DF}$: a time elapsed before fracture occurrence (hr.) as tested under said shear stress in a 20% ammonium thiocyanate solution at 50° C.

This steel wire according to the present invention has a high the thermal permanent set resistance and high delayed fracture properties. Particularly, the steel wire is excellent in the thermal permanent set resistance at around 200° C., and best suited for a spring for automobile engines and associated peripheral parts thereof.

In this connection, it may be preferable that the steel wire further contain 0.01-1.0 mass % of Ni and/or at least one of 0.01-0.15 mass % of Ti and 0.01-0.15 mass % of V.

It may also be desirable to keep the lattice distorsion of the ferrite in the pearlite structure in the range of 0.05-0.2%.

As to a method for manufacturing the above-mentioned steel wire according to the present invention, a die angle of the die used in drawing may be set at 10-8° in the method of manufacturing a steel wire comprising a patenting step followed by a drawing step. Further, it is desired that the bearing length of a die having a diameter of d be in the range of d/4-d/5.

Now, the aforementioned features of the steel wire according to the invention will be discussed further in detail.

Formula (4)

When the steel wire is used as a spring, particularly, as a heat-resistant spring, the following three factors will have an important meaning in respect of its working environment: (1) working temperature. (2) working time, and (3) working stress. As will be apparent from experimental examples to be described herein later, it has been found that satisfying the foregoing formula (4) is effective in improving the heat resistance of the steel wire. For reference's sake, though the conditions of the formula (4) are satisfied with an Si—Cr steel oil tempered steel wire or the like, such a steel wire is not only expensive, but unable to satisfy the succeeding formula (5) and inferior in delay fracture properties.

Formula (5)

Another important properties for spring include superiority in delayed fracture properties. As will be shown in experimental examples to be described herein later, satisfying the formula (5) is very effective in improving the delayed fracture properties later. For evaluating the delayed fracture properties the steel wire, a stress condition has an important meaning as its working environment. Although heretofore the delayed fracture properties have been typically evaluated in tensile stress, it is particulary important for a steel wire for spring to evaluate it in terms of torsion stress because such springs are often used in environments involving an application of torsion. Moreover, because of a necessity, in evaluating the delayed fracture, of fixing constant the condition of hydrogen ingress which may cause a delayed fracture, for the evaluation purpose the steel wire specimens were immersed in a 20% ammonium thiocyanate solution at 50° C.

C: 0.7-1.0 Mass %

With a C content below 0.7 mass % the steel wire will show a decrease in strength, particularly in fatigue strength, while its content exceeding 1.0 mass % will lowers the drawing workability, thus decreasing the productivity.

Si: 0.5-1.5 Mass %

With an Si content below 0.5 mass % the heat resistance will be decreased, while its exceeding 1.5 mass % will lowers the drawing workability, thus decreasing the productivity.

Cr: 0.2 Mass % or Less

Although the strength may be improved by the addition of Cr, its content exceeding 0.2 mass % will elongate the heat treatment time required for pearlite transformation and result in remarkable reduction in productivity. Here, if the Cr content is in the range of 0.04-0.1 mass %, it is more preferable that the Ni content be ¼ of the Cr content (mass %) or more but 1.0 mass % or less.

Lattice Distorsion: 0.05-0.2%

If the amount of lattice distorsion is below 0.05%, the steel wire will have a low heat resistance, while if it exceeds 0.2%, such a low material strength will result that fails to satisfy a property required for spring.

Ni: 0.01-1.0 Mass %

A Ni content below 0.01 mass % will result in poor delayed fracture properties. With a Ni content exceeding 1.0 mass % its effect on improvement of the delayed fracture properties will be saturated, only adding to the cost because of expensiveness of nickel. However, in order for this added component to exhibit a sufficient effect on the improvement of both the heat resistance and the delayed fracture properties, it may preferably be contained in an amount in the range of 0.1-1.0 mass %. Further, a Ni content of 0.2-1.0 mass % is more preferable for securing a heat resistance at a temperature range exceeding 200° C. for a prolonged period.

At Least One of Ti and V: 0.01-0.15 Mass % Each

If the content of neither of Ti and V is 0.01 mass % or above the steel wire will have poor delayed fracture properties, while if either one is contained in an amount exceeding 0.15 mass %, the steel wire will have a decreased toughness, and become difficult to be used as a spring.

Die Angle: 10-8°, Bearing Length: d/4-d/5, with d Representing Die Diameter

By thus limiting the die angle and bearing length, the macroscopic distribution of strains introduced in the course of drawing process, particularly, of strains at ferrite-cementite interfaces are uniformized, so that the strains at those interfaces may be readily relieved, while at the same time providing a heat resistance.

Further, the present invention provides a steel wire comprising a pearlite structure and containing 0.7-1.0 mass % of C and 0.5-1.5 mass % of Si, wherein in the pearlite structure the lattice constant a and the lattice distorsion $\Delta a_{LS}$ satisfy a relation given by the following formula:

$$0.001\times a \leqq \Delta a_{LS} \leqq 0.002\times a$$

The steel wire of the present invention having a pearlite structure of which the lattice constant and lattice distorsions are limited as above can have a remarkably improved fatigue strength.

Here, it is preferable that the steel wire contains Mn and Cr each in an amount of 1 mass % or less. As the most suitable applications, these steel wires according to the present invention may be further worked into springs or twisted to be used as springs for automobile parts and components requiring a high fatigue strength or as reinforcing steel wires including stranded PC steel wires, control cables, steel cords, parallel wires, etc. In worked into a spring, it is preferred that the resultant spring have a surface residual stress comprising a tensile stress of 100 MPa or less or a compression stress. A preferable range of the previously mentioned lattice constant a may be 2.8670-2.8705 Å.

Further, the present invention provides a steel wire comprising a pearlite structure and containing 0.7-1.0 mass % of C and 0.5-1.5 mass % of Si, wherein in the pearlite structure the lattice constant a and the lattice distorsion $\Delta a_{LS}$ satisfies a relation given by the following formula:

$$0.0025\times a \leqq \Delta a_{LS} \leqq 0.0045\times a$$

In this case, it is preferable that the lattice constant a is in the range of 2.8670-2.8710 Å.

Further, according to the present invention, the most suitable method to produce the steel wire just described above comprises the steps of: cold-working a steel material of pearlite structure containing 0.7-1.0 mass % of C and 0.5-1.5 mass % of Si, so that the resultant steel wire has a lattice constant $a_1$ and lattice distortion $\Delta a_{Ls1}$ satisfying the following formula (1) after the cold-working process:

$$0.0025\times a_1 \leqq \Delta a_{LS1} \leqq 0.0045\times a_1;\ \text{and} \quad (1)$$

heat-treating the resultant steel wire, so that the lattice constant $a_2$ and the lattice distortion $\Delta a_{Ls2}$ thereof satisfy the following formula (2):

$$0.001\times a_2 \leqq \Delta a_{LS2} \leqq 0.002\times a_2 \quad (2)$$

Here, it is preferable that the steel wire contains Mn and Cr each in an amount of 1 mass % or less. The cold-working process includes wire drawing, roller die drawing, swaging, a rolling, forging and so on. In addition, the $a_1$ may preferably be in the range of about 2.8670-2.8710 Å, the $a_2$ in the range of 2.8670-2.8705 Å. By the cold working, a moderate strain is introduced so as to adjust the strength to a reasonable level, and the subsequent heat treatment relieves the strain moderately, so that microscopic defects may be prevented from concentrating at limited points in order to eliminate or minimize origins of fatigue fracture and thereby to improve fatigue properties. In this connection, the prior art steel wires have typically had a lattice constant $a_3$ in the range of 2.8665-2.8710 Å and a lattice distorsion $\Delta a_{LS3}$ in the range of $0.001\times a_3$–$0.0045\times a_3$ after cold working. Further, the prior art steel wires have typically had, after heat treatment, a lattice constant $a_4$ in the range of 2.8665-2.8695 Å and a lattice distorsion $\Delta a_{LS4}$ of $0.0015\times a_4$ or above, showing a low fatigue strength In this context, as to the conditions of drawing (cold working) after the patenting process, (1) the smaller the die approach angle, (2) the smaller the working ratio and (3) the smaller the drawing angle are, the smaller the variation in lattice distorsions becomes. In addition, as to the conditions of heat treatment after the drawing process, the higher the heat treatment temperature is, the smaller the variation in lattice distorsions is. Further, (1) the lattice constant increases with the Si content, (2) the variation in lattice constants increases as the reduction ratio of cold-working decreases, and (3) the variation in lattice constants increases with the heat treatment temperature.

As will be shown in experimental examples to be described hereinafter, it has been found that limiting the lattice constant and the lattice distorsion as mentioned above is effective in remarkably improving the fatigue properties of the steel wire. That is to say, the inventors have for the first time revealed a correlation between lattice distorsion and fatigue and found out that by controlling the lattice distorsion within a proper range such defects as to cause fatigue can be eliminated and the fatigue properties can be improved.

These lattice constants per se have been observed with the prior art steel wires (, however, without being controlled). However, it has not been so far practiced nor proposed to specifically limit or define the lattice distorsion as falling in a range befitting to the lattice constant. In other words, simply based on an idea that increasing the tensile strength might also increase the fatigue strengths, the following measures have heretofore taken, without being able to improve the fatigue strength: (1) increasing the strength of pearlite (decreasing the patenting temperature), (2) increasing the working ratio of drawing and (3) increasing the material strength by increasing the C content.

Contrary to the aforementioned situations, the inventors have found out that the average amount of strains and the distribution thereof having effect on the improvement of fatigue strength may be controlled. These findings shows that a preferable average amount of strain may be provided by a lattice constant in the range of 2.8670-2.8705 Å and a preferable strain distribution may be provided by a lattice distorsion $\Delta a_{LS}$ defined as $0.001 \times a \leqq \Delta a_{LS} \leqq 0.002 \times a$. These facts indicate that the fatigue properties may not be improved by merely resorting to such factors as patenting condition, working ratio and chemical composition, etc. as in the prior art, and that the fatigue strength is not determined only by the tensile strength of final products.

The lattice constant may be determined by X-ray diffraction. While the lattice distorsion may also be determined by X-ray diffraction, an analysis based on the half-width (width at half-height) of ordinary diffraction peaks and the like is qualitative in nature, and even if the half-width is digitized absolute values resulting therefrom may have a low accuracy, so that it may sometimes be impossible to tell which of two values is larger should their difference be several 10% or less. Then, the inventors have undertaken a series of intensive studies on a methodology that enables these parameters to be evaluated with a high degree of accuracy, and consequently have successfully found out a range of material parameters that can contribute to the improvement of fatigue properties. As contrasted to usual X-ray diffraction methods used heretofore, this method determines the lattice distorsion apart from crystal particle size by calculation based on a so-called Wilson method.

First, the lattice distorsion will be discussed. The lattice distorsion will be produced by uneven or non-uniform deformation, rotation, displacement, and working, etc. of unit cells occurring internally of crystals and, microscopically, are caused by point defects and dislocations, etc. Since a unit cell has a size that may be larger or smaller than ideal size of a unit cell involving no strain, there will remain a stress such as a tension or compression. When measuring the lattice size in a material involving such a lattice distorsion by a X-ray diffraction method, its diffraction peak will not become sharp accompanied by a broad width. The extent of the strain may be roughly determined by evaluating the half-width of the diffraction peak (measuring the width of the peak at a height half the peak height).

However, this width may be broadened due to such factors as intrinsic characteristics of the instruments used and crystal particle size (X-ray crystallographic particle size) in addition to the unit cell size. Therefore, in order to evaluate the variation in unit cell size correctly, these factors must be separated one from another. For this purpose, the lattice distorsion is measured accurately.

Now, description will be made on a method for measuring the lattice distorsion. This is a method that is used often for evaluation of ceramics or the like materials. Half-widths of several diffraction peaks are determined, and then the lattice distorsion and crystal particle size are calculated independently of other factors by a so-called Wilson method. Several diffraction peaks are measured, and half-width (integration width) of each peak is determined. In the instant example, 5 diffraction peaks of 110, 200, 211, 220, and 311 are measured. Instrument parameters are calibrated using a half-width of one and the same diffraction peak for a reference sample (a pure iron powder in the instant example), and then a half-width to be affected only by lattice distorsion and crystal particle size is determined. $(\Delta 2\theta)/(\tan \theta_o \cdot \sin \theta_o)$ is plotted as ordinate against $(\Delta 2\theta)^{\cdot 2}/\tan^2\theta$as abscissa, and the intercept of the plotted locus is determined. Square root of the resultant intercept is divided by 4 to give a lattice distorsion value intended here. (Expansion of the half-width due to crystal particle size is approximated by a Cauchy function, and expansion due to lattice distorsion by a Gauss function.)

It is not always necessary to use 5 diffraction peaks. Further, while it is not always necessary to use the same diffraction peaks as those used in the instant case, accuracy increases as the number of diffraction peaks increase. For evaluation, a value indicating the state of strain distribution is used, with the value being given in an absolute number (or as percentage). Here, $\Delta 2\theta$ is a half-width (integration width) in "radians", and $\theta_0$ a diffraction angle in "degrees". By controlling the lattice distorsion with respect to a given C content and Si content based on such an evaluation method as described above, it becomes possible to achieve improved fatigue properties of steel wire that have not been achievable with such a usual evaluation based on the half-width of X-ray diffraction peak as used heretofore.

In the above-described steel wire and method for manufacturing the same according to the present invention, the steel wire is limited in respect of chemical composition and metal structure thereof based on the grounds set force immediately below:

C (0.7 mass % or more, up to 1.0 mass %) is the most effective element to increase the strength of steel wire. With a content less than 0.7 mass % no sufficient strength can be obtained, while its content exceeding 1.0 mass % will bring about a segregation problem, resulting in an impracticability.

Si (more than 0.5 mass %, up to 1.5 mass %) acts basically as a deoxidizer, and is required for decreasing the content of nonmetallic inclusions. An Si content more than 0.5 mass % shows a great effectiveness of strengthening a solid solution, thereby further improving the fatigue properties.

Like Si, Mn also acts as a deoxidizer. With an Mn content above 1 mass %, the hardenability is increased and a longer time is required for pearlite transformation, thus resulting in decreased productivity.

While Cr is effective in increasing the strength, its content may preferably be 1% or less because its content exceeding the upper will increase the hardenability like Mn.

According to the present invention, a pearlite steel is used because it provides a good balance between strength and toughness in the drawing process.

THE BEST MODE FOR CARRYING OUT THE INVENTION

EXPERIMENTAL EXAMPLE 1-1

Figure 1:
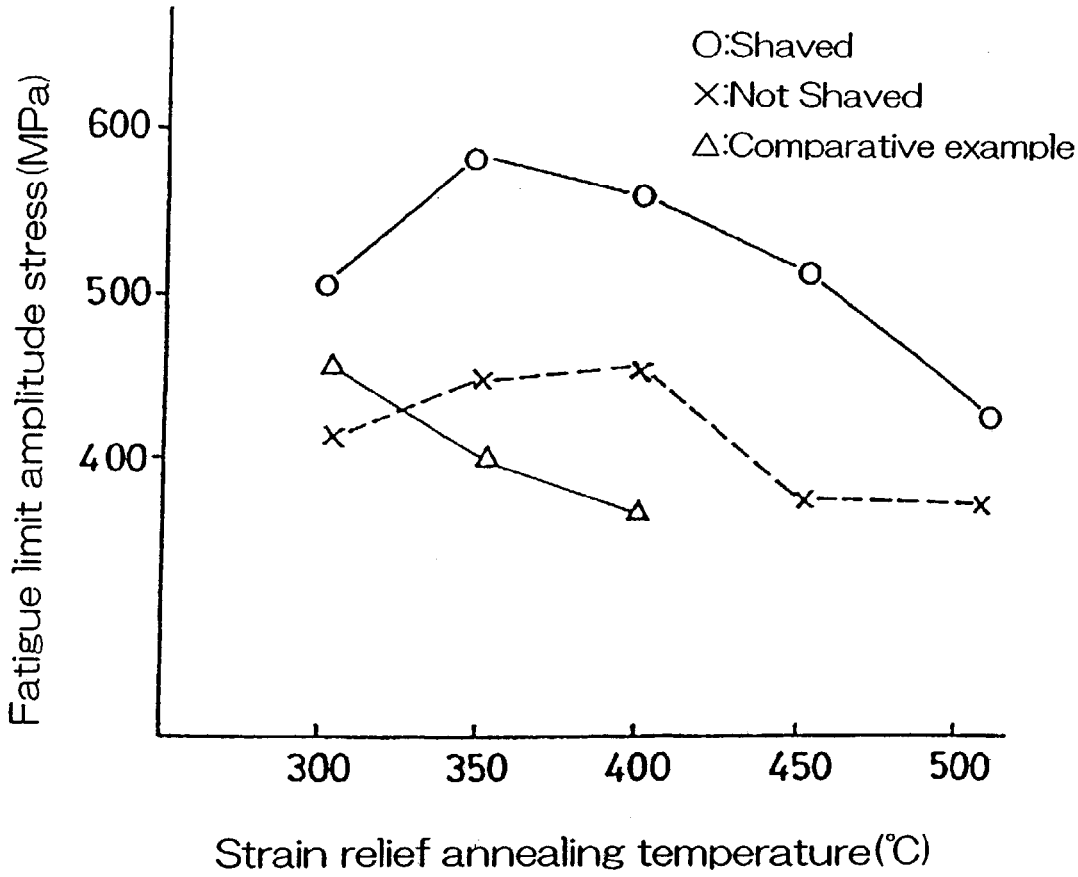
FIG. 1 is a graph showing a relation between strain relief annealing temperature and fatigue limit amplitude stress.

An ingot weighing 100 kg containing 0.82 mass % of C, 1.05 mass % of Si, 0.51 mass % of Mn and 0.09 mass % of Cr was melt-cast in a vacuum melting equipment, and the resultant cast product was worked through hot-forging and rolling into wire rods of 11 mmϕ and 10 mmϕ, respectively. Out of those, wire rods of 11 mmϕ were shaved to remove surface layers to 10 mmϕ Then, the shaved and non-shaved 10 mmϕ wire rods were both subjected, under the conditions given below, to patenting, drawing, and strain relief annealing to be worked into steel wires of pearlite structure.

Patenting: 950° C. lead bath at 580° C.

Drawing: 10 mmϕ→4 mmϕ

Strain relief annealing: at 300° C., 350° C., 400° C., 450° C., 500° C. for 20 min. each Further, as comparative examples a steel species containing 0.6-0.8 mass % of C, 0.15-0.35 mass % of Si and 0.3-0.9 mass % of Mn was worked into steel wires of 4 mmϕ through the following processes: melt-casting→rolling→patenting→drawing (84% reduction ratio in cross-sectional area)→strain relief annealing (at 300±30° C.)

Then, each resultant steel wire was subjected to a fatigue test on a Nakamura's rotating bending fatigue tester with its withstanding minimum fatigue threshold being set at $10^7$ times of bending stress application. The steel wires subjected to the fatigue test were straightened before the strain relief-annealing step to remove their curls introduced in the drawing step. The test results are given in FIG. 1. Hardness distribution over the cross section of each steel wire was also determined, the results of which are given in FIG. 2.

As can be seen in FIG. 1, the steel wires worked through shaving exhibit a greater fatigue limit amplitude stress and a higher fatigue strength as compared with non-shaved steel wires. In particular, among the shaved wires, those strain relief annealed at 350-450° C. exhibits a good result, while even the non-shaved steel wires exhibit a better result as compared with the comparative examples when strain relief annealed at 350-400° C.

Figure 2:
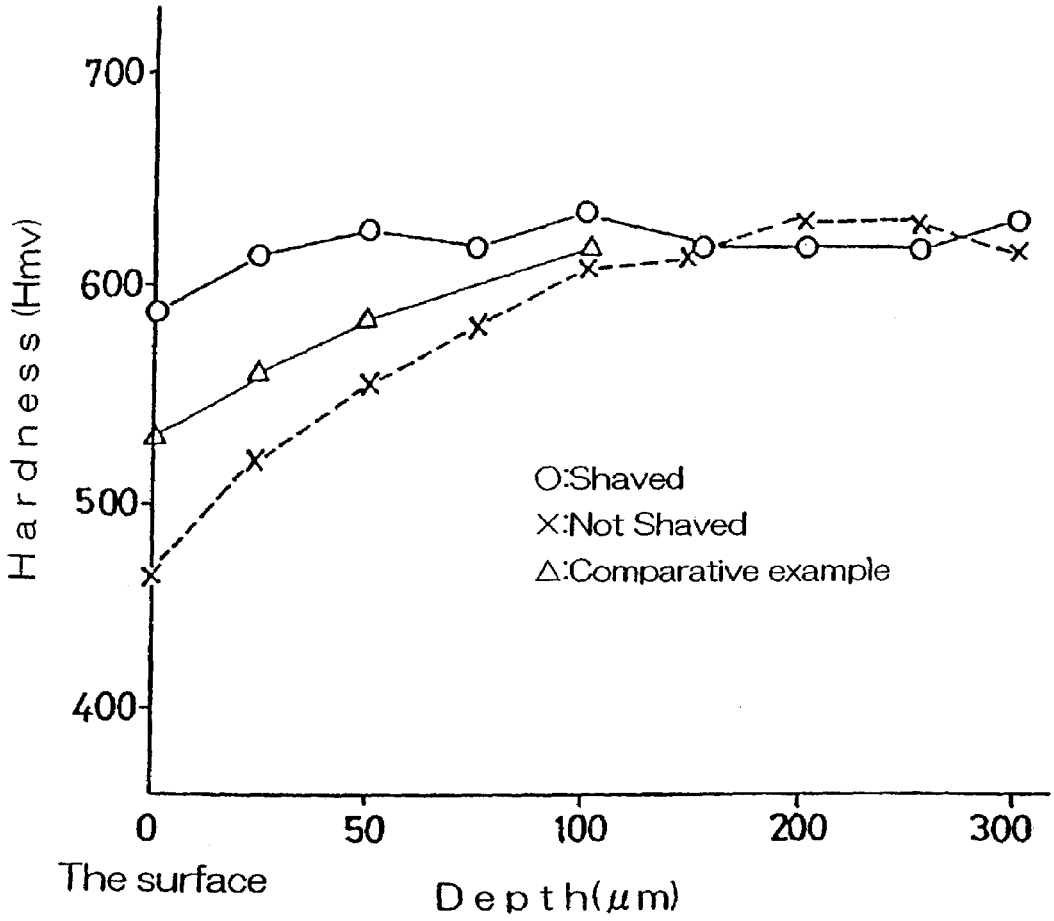
FIG. 2 is a graph showing a hardness distribution over the cross sections of each steel wire.

In addition, as can be seen in FIG. 2, the non-shaved wire rods resulted in decreased hardness in regions close to the surface, while the shaved wire rods provided a substantially even hardness distribution from center to surface across their cross section. Then, it has been found that steel wires which in the cross section thereof the difference in average hardness between a region up to 50 μm from the surface thereof and a more deeper region is within 50 in micro-Vickers hardness has an improved fatigue strength. Further, the respective steel wires had the following tensile strength as maximum:

Shaved steel wire: 2,130 N/mm$^2$

Non-shaved steel wire: 2,110 N/mm$^2$

Comparative example:1,900 N/mm$^2$

EXPERIMENTAL EXAMPLE 1-2

Then, steel species having chemical compositions given in Table 1 below were vacuum-melted like the aforementioned experimental example 1-1, and the resultant products were worked through hot forging and rolling, shaving, drawing, and strain relief annealing (at 350° C. for 20 min.) in the like manner as experimental example 1-1.

TABLE 1

| | | Chemical composition (mass %) | | | | | |
|---|---|---|---|---|---|---|---|
| | | C | Si | Mn | Cr | Mo | Notes |
| Specimen No. | 1-1 | 0.67 | 0.88 | 0.51 | 0.06 | | |
| | 1-2 | 0.72 | 0.92 | 0.49 | 0.05 | | |
| | 1-3 | 0.92 | 0.93 | 0.51 | 0.05 | — | |
| | 1-4 | 0.97 | 0.91 | 0.53 | 0.06 | — | |
| | 1-5 | 1.07 | 0.92 | 0.52 | 0.07 | — | Patenting produced martensite |
| | 2-1 | 0.82 | 0.23 | 0.48 | 0.05 | — | |
| | 2-2 | 0.81 | 0.51 | 0.49 | 0.06 | — | |
| | 2-3 | 0.80 | 1.43 | 0.49 | 0.06 | — | |
| | 2-4 | 0.82 | 1.72 | 0.50 | 0.05 | — | Numerous surface flaws |
| | 3-1 | 0.81 | 0.98 | 0.52 | 0.07 | 0.07 | |
| | 3-2 | 0.80 | 1.02 | 0.51 | 0.08 | 0.12 | Patenting produced martensite |

Then, the steel wire specimens were subjected to evaluation of heat resistance and rotating bending fatigue test. Heat resistance was evaluated by determining a residual shear stress as a permanent set as held under torsion stress of 700 MPa for 1 hr at 150° C. More specifically, the bases of evaluation are that the residual shear stress is 0.075% or below which is a half or lower level had by the prior art piano wires (steel wires substantially equivalent to that of the comparative example in the experimental example 1-1) and that fatigue limit amplitude stress is 550 MPa or more indicating a 20% or higher improvement over the prior art piano wires. The result of evaluation is shown in FIG. 3.

Figure 3:
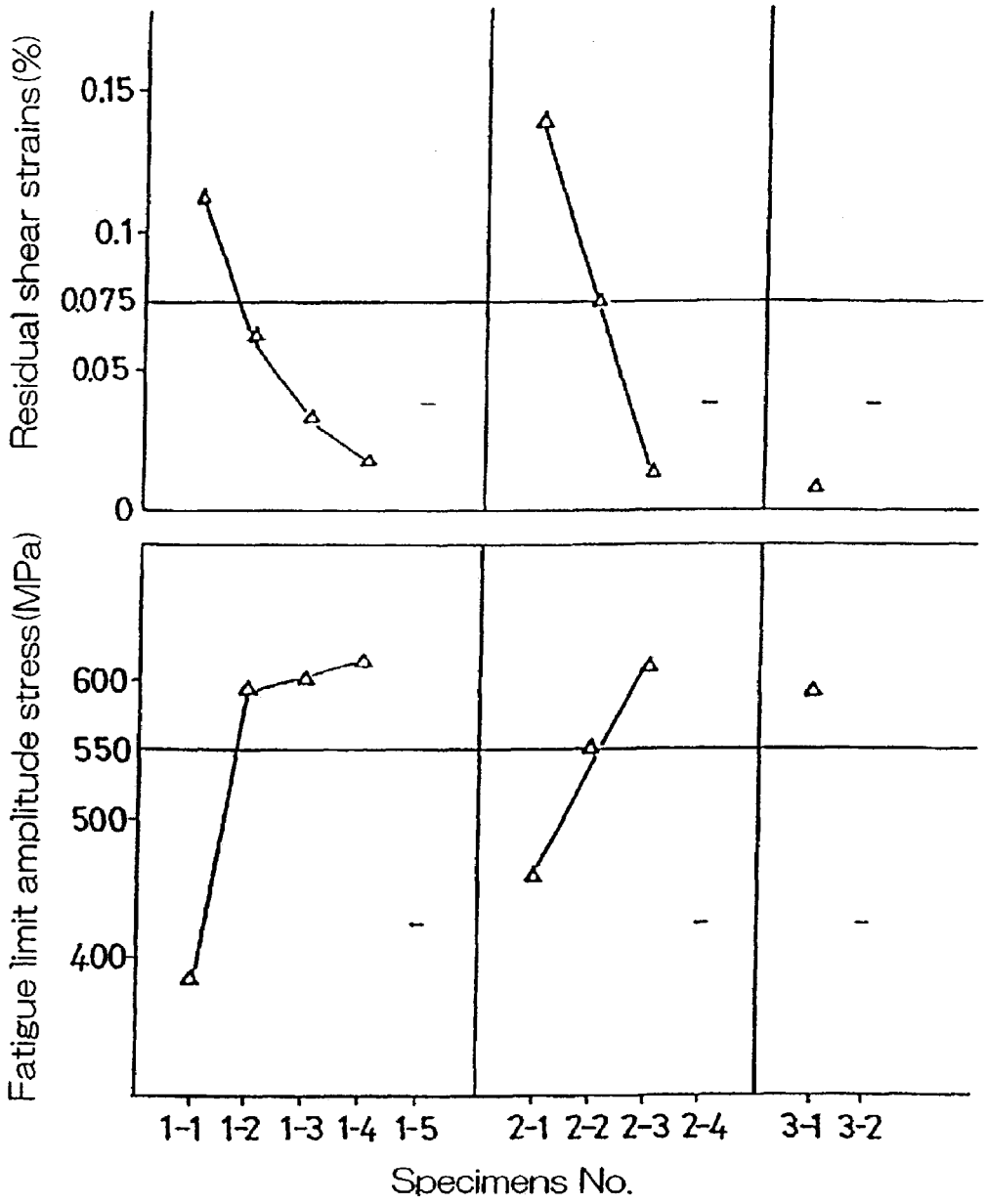
FIG. 3 is a graph showing a relation between residual shear strains of steel wires having varied chemical compositions and fatigue limit amplitude stresses thereof.

As shown in FIG. 3, the specimen No. 1-5 having a higher C content, specimen No. 2-4 having a higher Si content and specimen No. 3-2 with a higher Mo content were considered as inadequate as steel wires, because either martensite produced or numerous surface flaws occurred due to patenting. Also, it can be seen that the specimen No. 1-1 having a lower C content and specimen No. 2-1 having a lower Si content are unsatisfactory in respect of fatigue strength and heat resistance. Meanwhile, the specimens No. 1-2 through 1-4, 2-2, 2-3 and 3-1 all exhibit a satisfactory result in respect of fatigue strength and heat resistance. Particularly, the specimen No. 3-1 containing a proper content of Mo exhibited a high fatigue strength and heat resistance.

EXPERIMENTAL EXAMPLE 1-3

The same wire rod of 11 mmϕ as used in the foregoing experimental example 1-1 was worked into steel wires of 4 mmϕ through the same process steps as used in the experimental example 1-1. In this example, however, the cooling rate during the period from γ-phase transition to isothermal transformation during the patenting process was varied so as to evaluate the effect of the cooling rate on the relation between metal structure and spring properties (fatigue limit amplitude stress and residual shear strain).

Relation between Metal Structure and Spring Structures

Figure 4:
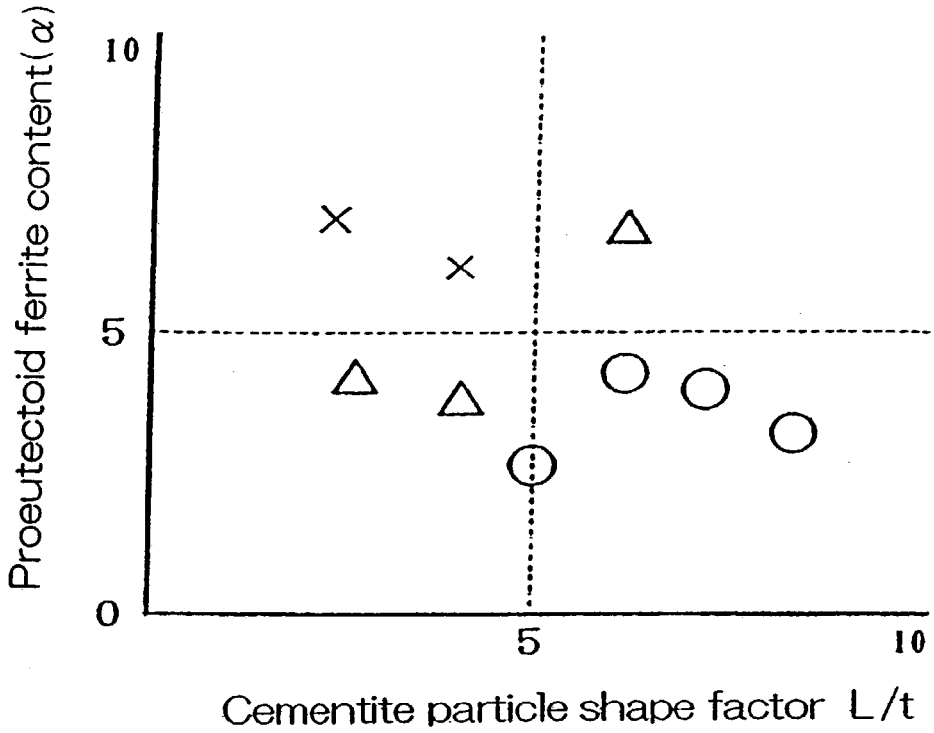
FIG. 4 is a graph showing a result of evaluation of spring properties by both varied cementite particle shape factor L/t and varied proeutectoid ferrite content $\alpha$.

Result of evaluation of spring properties by variations in shape factor L/t of cementite particles (t: thickness in μm, L: length in μm) and proeutectoid ferrite content α (vol. %) is shown on the graph of FIG. 4. The evaluation was made on the basis given in Table 2 below.

TABLE 2

| | | Fatigue limit amplitude stress | |
|---|---|---|---|
| | | Below 550 MPa | 550 MPa or above |
| Residual shear strain | Above 0.075% | ○ | Δ |
| | 0.075% or less | Δ | ○ |

As can be clearly seen from the graph of FIG. 4, a steel wire exhibits a satisfactory spring properties when its cementite particle shape factor L/t satisfies L/t≧5 and its proeutectoid ferrite content α satisfies α ≦5. Further, if a proportion of cementite satisfying L/t≧5 is 80% or more, stability increases in spring properties, particularly in permanent set resistance.

Relation between Process Conditions and Structure

Using the same steel species as those of the specimens No. 1-2 through 1-4, 2-2,2-3 and 3-1, the effect on metal structure had by T given by the following formula and cooling rate after heating for γ-transition was determined. T is shown in Table 3 below for each specimen, and the test result is given on the graph of FIG. 5.

TABLE 3

| Specimen No. | T |
|---|---|
| 1-2 | −0.82 |
| 1-3 | 0.92 |
| 1-4 | 1.49 |
| 2-2 | 0.29 |
| 2-3 | −0.73 |
| 3-1 | −0.13 |

Figure 5:
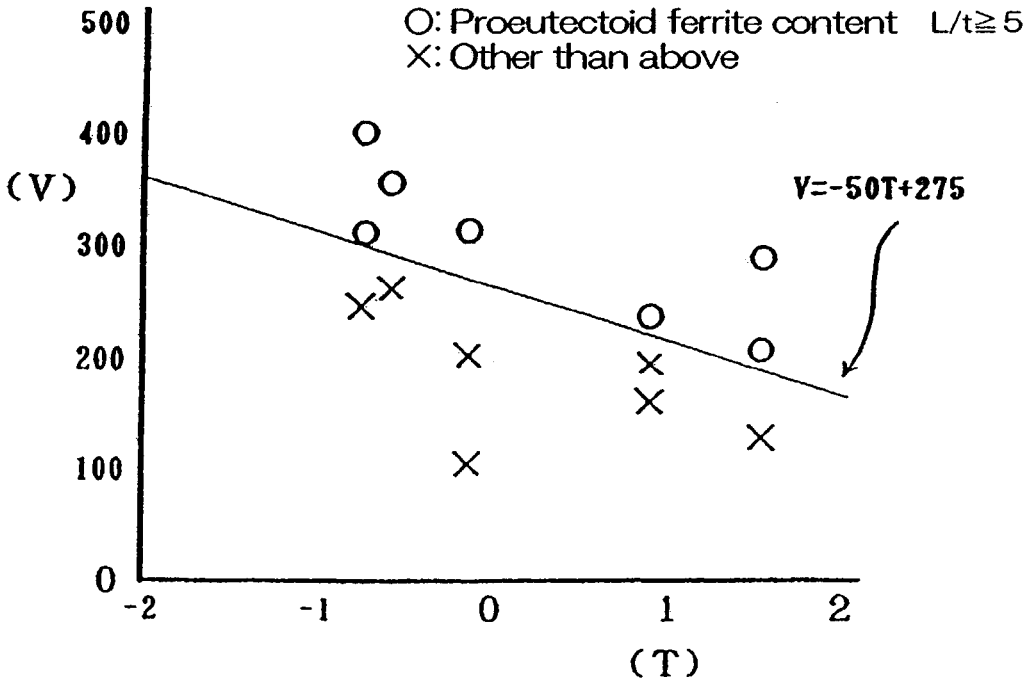
FIG. 5 is a graph showing effects on the metal structure had by temperature T and cooling rate V after heating for $\gamma$-phase transition.

As can be seen from the graph of FIG. 5, a satisfactory structure may be obtained when cooling rate V satisfies V≧−50T+275.

EXPERIMENTAL EXAMPLE 2-1

A material of the preferred example 1 and that of comparative example 1 having chemical compositions as shown in Table 4 were worked into wire rods of 5 mmϕ, respectively, through the following process steps: rolling→patenting→wire drawing→heat treatment (strain relief annealing). In the processes, wire rods in rolling were 12.3 mmϕ, patented at 950° C. with transformation temperature of 560° C., and final drawn size was 5 mmϕ, heat treatment being applied at 350° C. for 20 min.

TABLE 4

| | C | Si | Mn |
|---|---|---|---|
| Preferred example 1 | 0.82 | 0.92 | 0.78 |
| Comparative example 1 | 0.83 | 0.21 | 0.76 |

(mass %)

Further, in the drawing process, the true strain was kept in the range of 0.1-0.25 and the distortion of the wire rod under being worked was kept within 10° per 100 mm of wire length, and the drawing direction was inverted when the wire rod was drawn down to 7 mmϕ.

The torsion was measured by using a torsion sensor mounted at a position just before the drawing die. The torsion sensor is provided with a ball roller which rotates with torsion of the steel wire, and a displacement per unit time at right angles to the machine direction is determined from the roller rotation so that the distortion is calculate based on the thus determined displacement of the wire per its 100 mm length.

Figure 18:
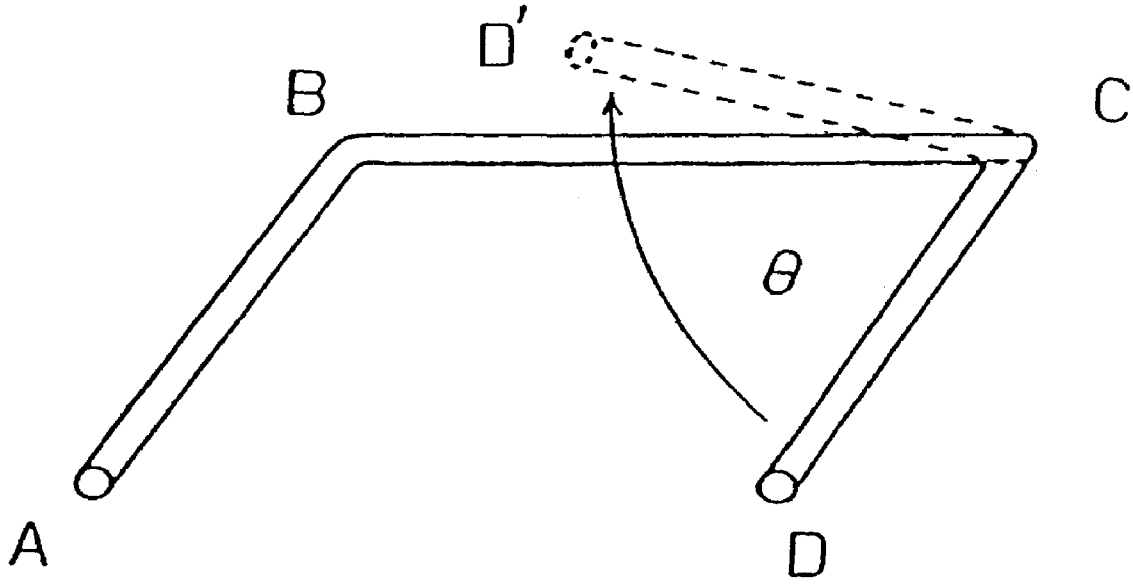
FIG. 18 is a schematic diagram illustrating a manner of applying a torsion stress to a steel wire.

Then, the resultant steel wires were held under stress load of 600 MPa for continuous 24 hours at 150, 200, and 250° C., respectively, to determine the residual shear strain as representing permanent set properties. After drawing, the steel wires was straightened and then bent into a U shape in order to proceed to evaluation of thermal permanent set resistance. As shown in FIG. 18, each U-shaped steel wire specimen had its one end A, right-angle bends B and C fixed, and its other end D lifted to and held at a position indicated at D' by an angle θ at the bend C, so that a torsion stress was applied to the B-C portion of the steel wire specimen. Each specimen as fixed with a jig at this position was placed in a furnace and after being heated therein at a predetermined temperature kept for a predetermined time, had its jig removed at a room temperature, and its residual shear strain was determined. Before being applied with torsion and fixed with jig, each U-shaped specimen was subjected to strain relief annealing at 350° C. for 30 minutes. At the same time, for a comparison purpose, ordinary OT wires were also evaluated in the similar manner as above purpose. The result of evaluation is shown in FIG. 6.

Figure 6:
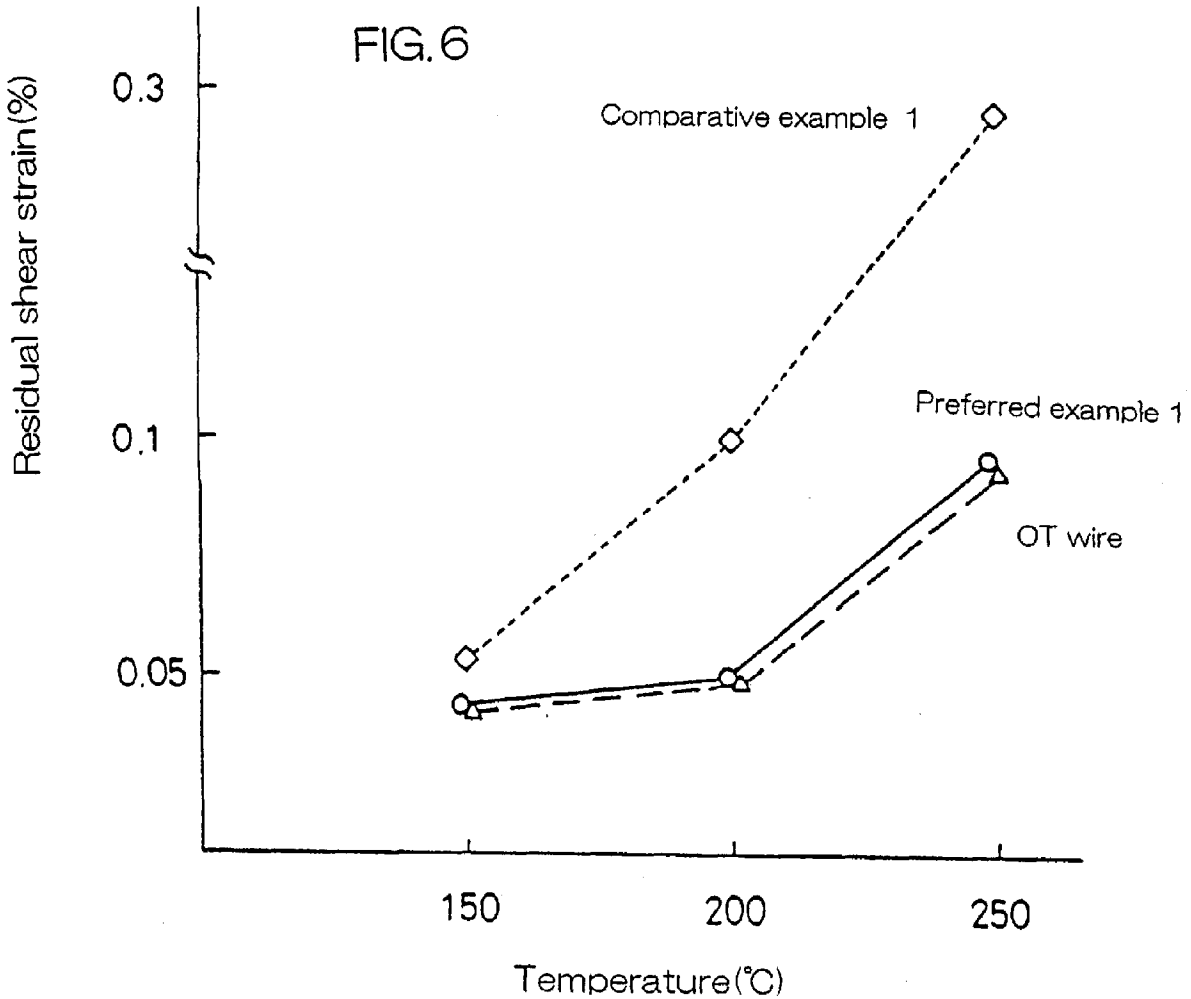
FIG. 6 is a graph showing a relation between temperature environment and residual shear strain.

As can be clearly seen on the graph of FIG. 6, the preferred example 1 has a heat resistance almost equal to that of OT wires at temperatures up to 250° C. Meanwhile, the comparative example 1 having a lower Si content has a large residual shear strain, and a low permanent set resistance at high temperatures.

EXPERIMENTAL EXAMPLE 2-2

Figure 7:
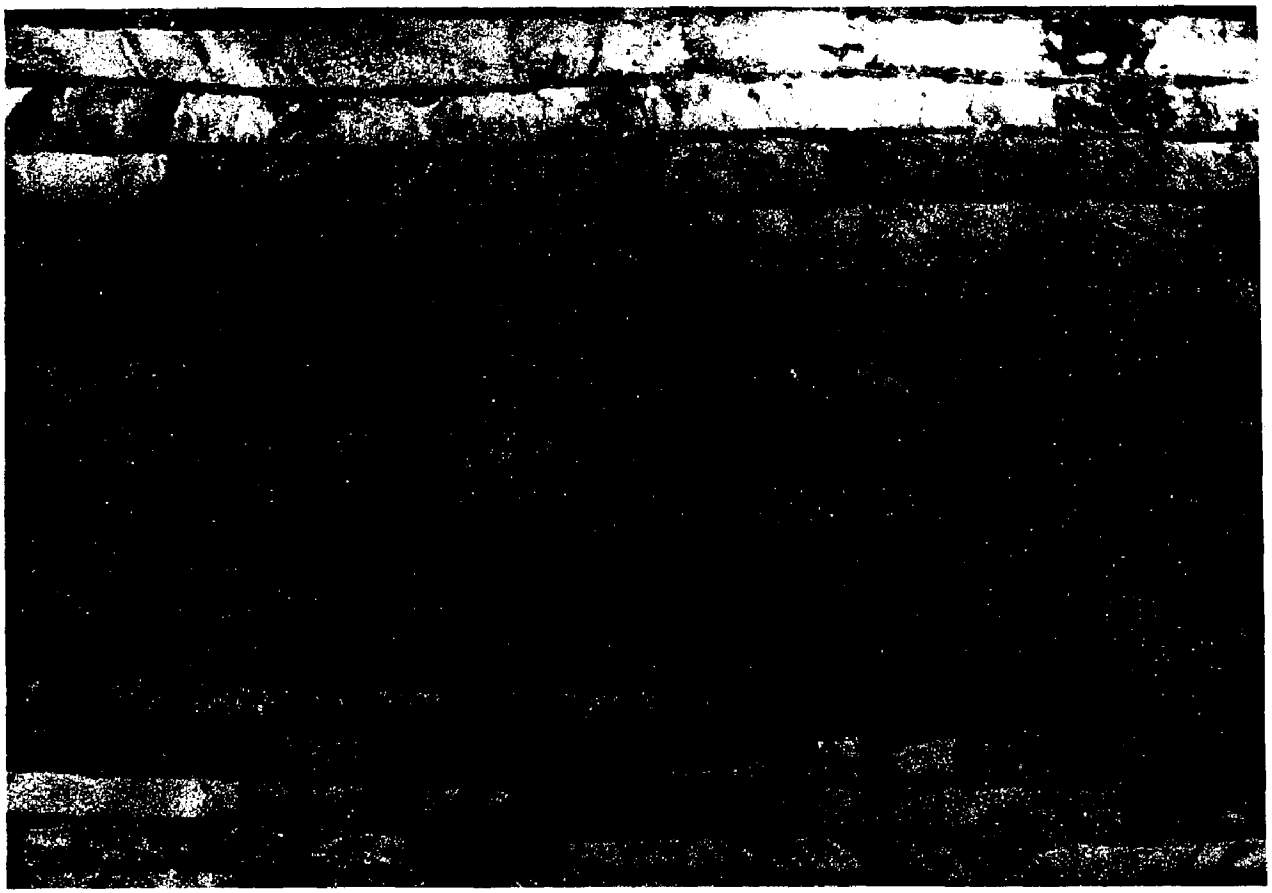
FIG. 7 is a photomicrograph showing a metal structure of a steel wire according to the present invention.
Figure 8:
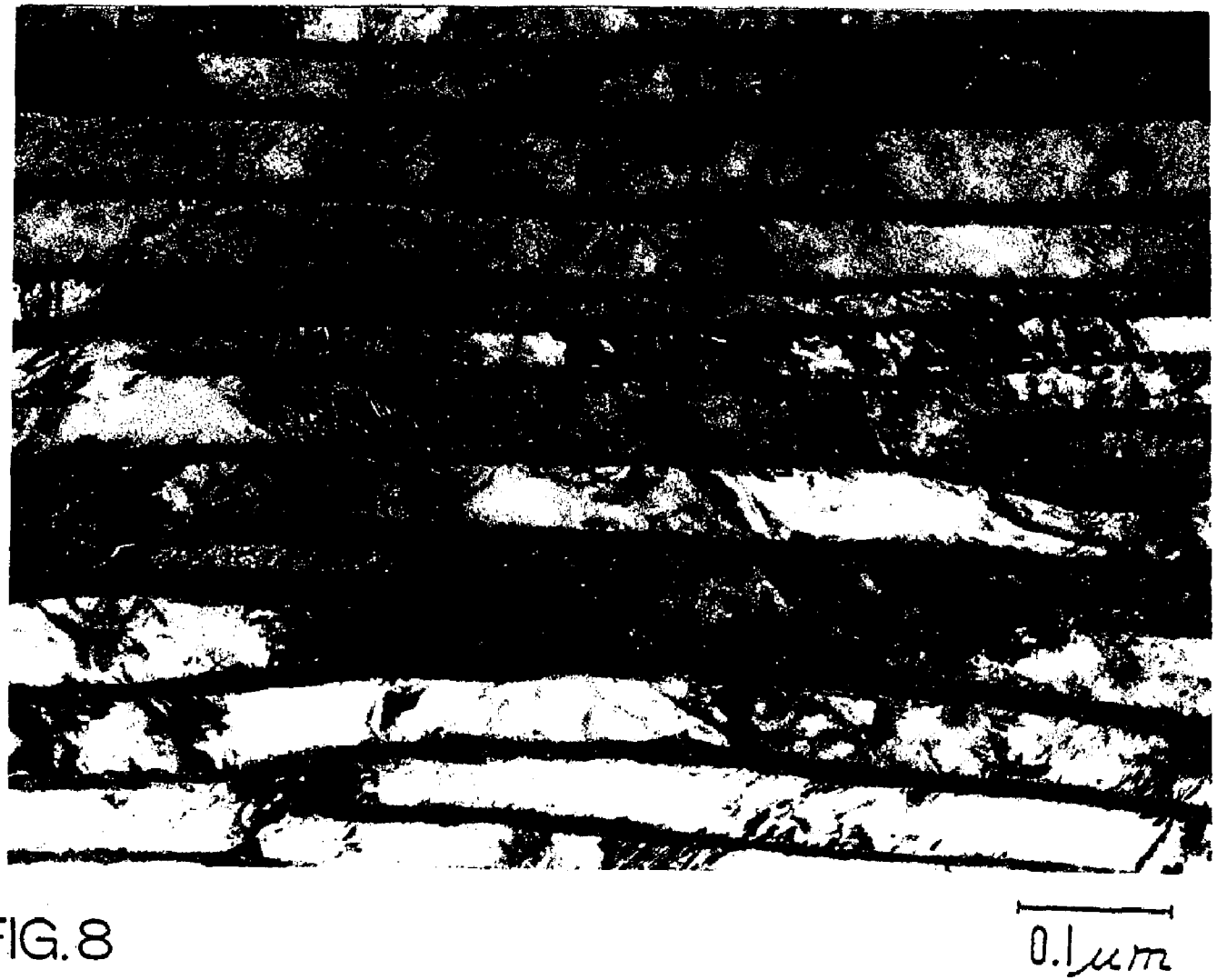
FIG. 8 is a photomicrograph showing a metal structure of a steel wire in the prior art.

Except that the drawing and heat treatment conditions were changed outside the conditions of the foregoing experimental example 2-1, the same procedures and conditions as in the preferred example 1 were repeated, and the resultant steel wire (comparative example 2) was subjected, along with the above said preferred example 1 to microscopic structure observation by TEM (Transmission Electron Microscope) (×200,000 magnification). The resultant photomicrograph of the structure of the preferred example 1 is shown in FIG. 7, and that of the comparative example 2 is shown in FIG. 8. In each photograph, thicker whitish layers are ferrite layers alternately arranged with thinner blackish layers comprising cementite layers. It is understood here that arcuate or semicircular strains are observed principally at interfaces between the ferrite and cementite layers in the comparative example 2, while no such distortion is observed in the preferred example 1. The cementite layers of the preferred example 1 had a thickness of approximately 5-20 nm. In this experimental example, the specimens to be subjected to TEM observation were sliced into a thickness of approx. hundreds μm, followed by grinding to be finally electro polished into thin films. Extraction of ion sputtering residues or the like procedure was not conducted due to concern about possible change in structure thereby.

Figure 9:
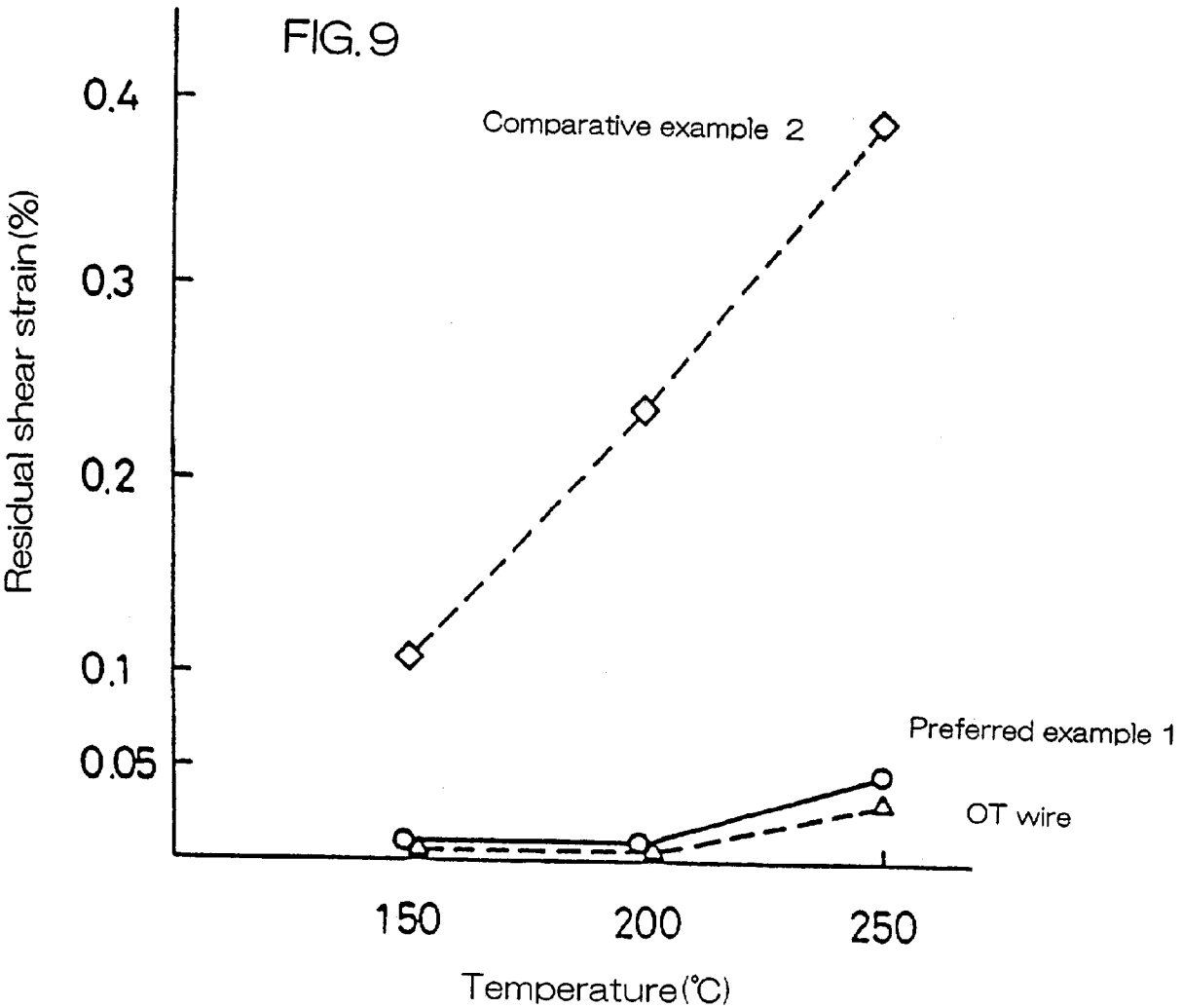
FIG. 9 is a graph showing residual shear strain in each preferred example and comparative example.

Then, the preferred example 1, comparative example 2 and OT wire specimens were evaluated for their heat resistance, the result of which is shown in FIG. 9. Heat resistance was evaluated by determining the residual shear strain after the specimen being loaded with a torsion stress of 300 MPa for continuous 24 hours. As shown in FIG. 9, the preferred example 1 has almost the same heat resistance as that of OT wire, while the comparative example 2 worked under different drawing conditions exhibits a low heat resistance.

EXPERIMENTAL EXAMPLE 2-3

Figure 10:
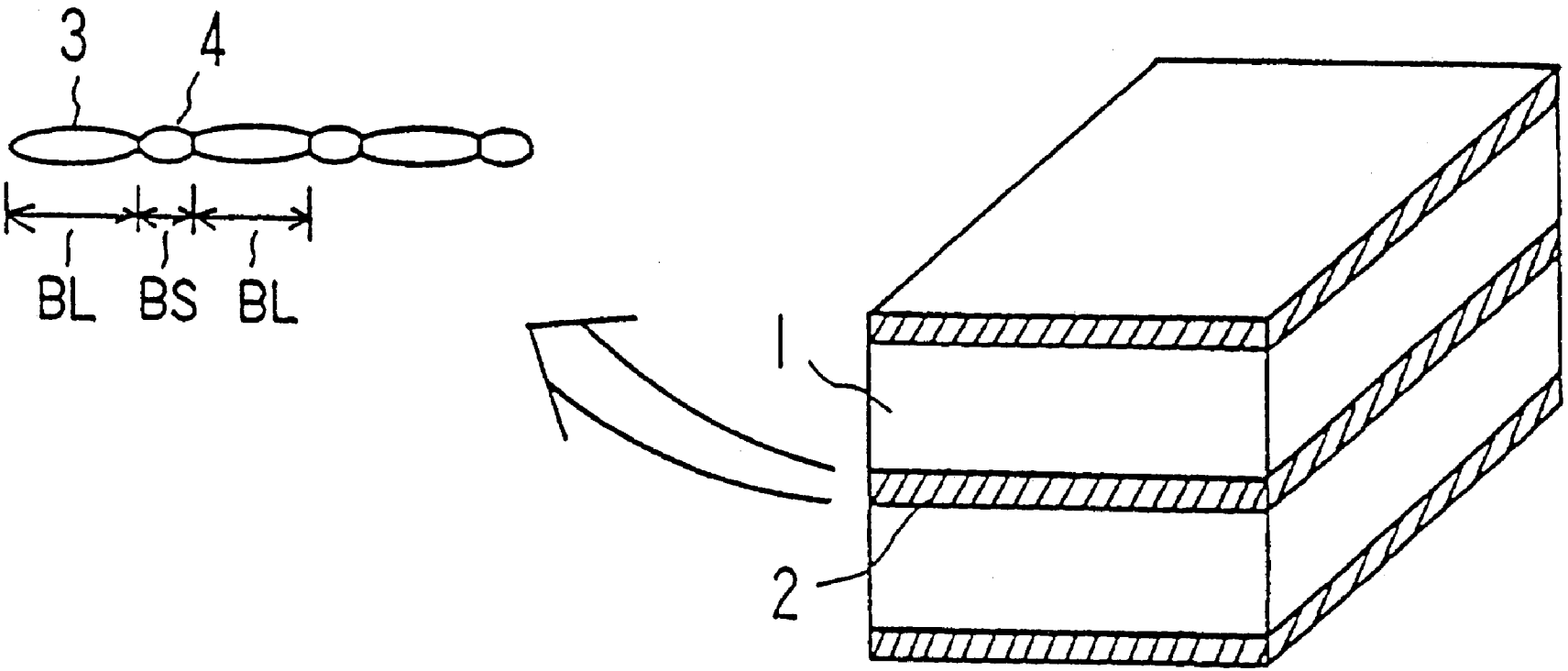
FIG. 10 is diagrammatic drawing illustrating metal structure of the steel wire according to the present invention.
Figure 11:
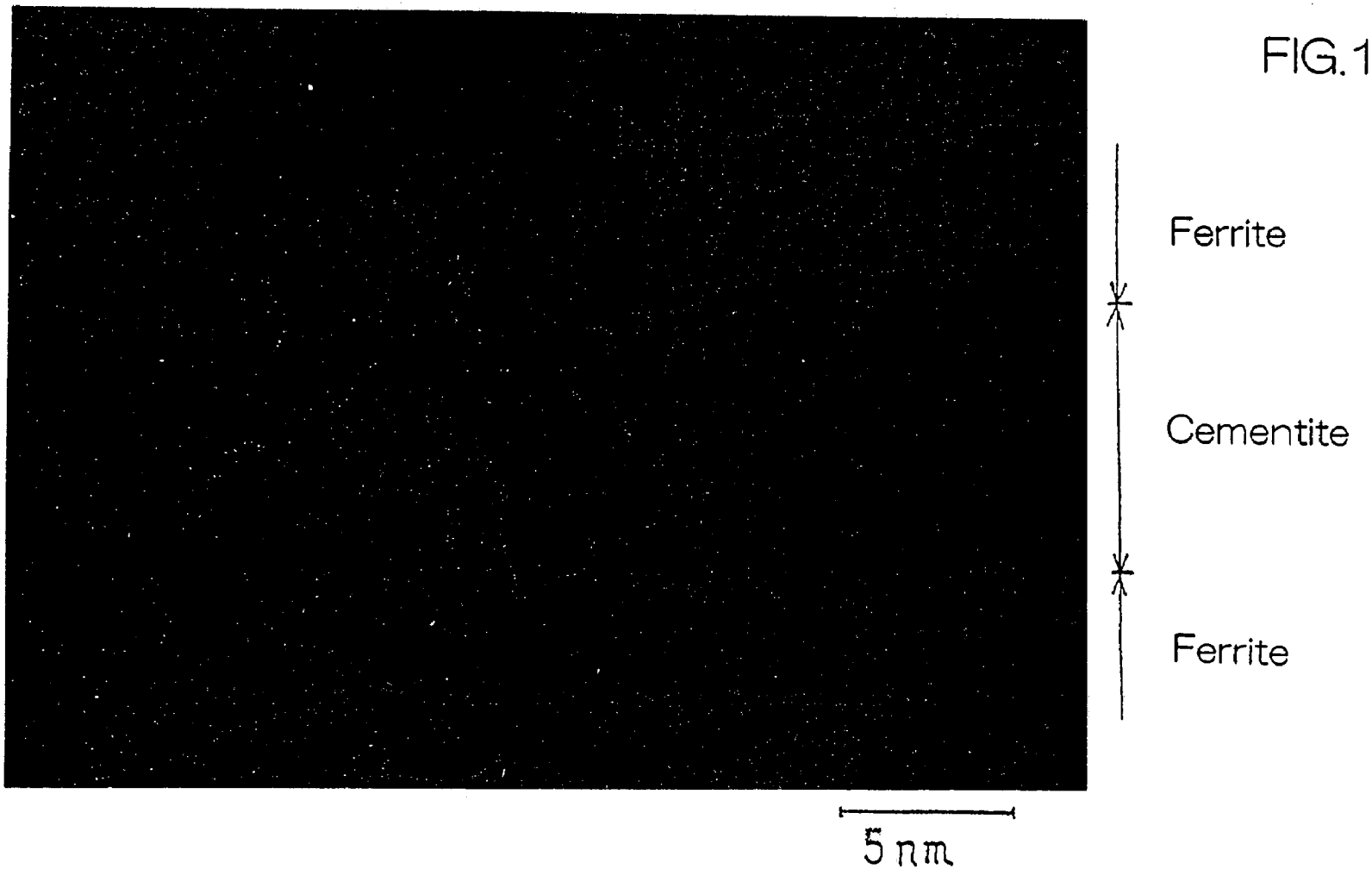
FIG. 11 is a photomicrograph showing metal structure of the steel wire according to the present invention.

Additionally, a diagrammatic view illustrating a cementite morphology of the aforementioned preferred example 1 is shown in FIG. 10, and its corresponding photomicrograph (5,000,000 magnification) is shown in FIG. 11. As shown in FIG. 10, this steel wire has a structure in which ferrite layer 1 and cementite layer 2 are laminated overlapped alternately with each other, and the enlarged cross section of a cementite layer shown reveals that the cementite layer has larger particles 3 of generally oval shape and smaller particles 4, the latter particles 4 being located alternately with the former particles 3. FIG. 11 also shows that there are a ferrite layer each on the upper side and underside of a ferrite layer, and particles of generally oval shape are arranged substantially alternately with particles of generally circular shape in the ferrite layer sandwiched there between. In the cementite structure shown in the photomicrograph of FIG. 11, circular-shaped particles of 15 nm in outside diameter are observed at interfacial structures between oval-shaped particles of about 60 nm and 50 nm in major and minor-axial lengths, respectively. Also for the comparative example 3 worked by changing the drawing and heat-treatment conditions from those of the preferred example 1 outside the conditions of the experimental example 2-1, the cementite structure morphology was determined likewise as above to reveal that cementite particles of 10-50 nm size were randomly arranged therein, and no regularity in structural arrangement as observed in the preferred example 1 was revealed.

Figure 12:
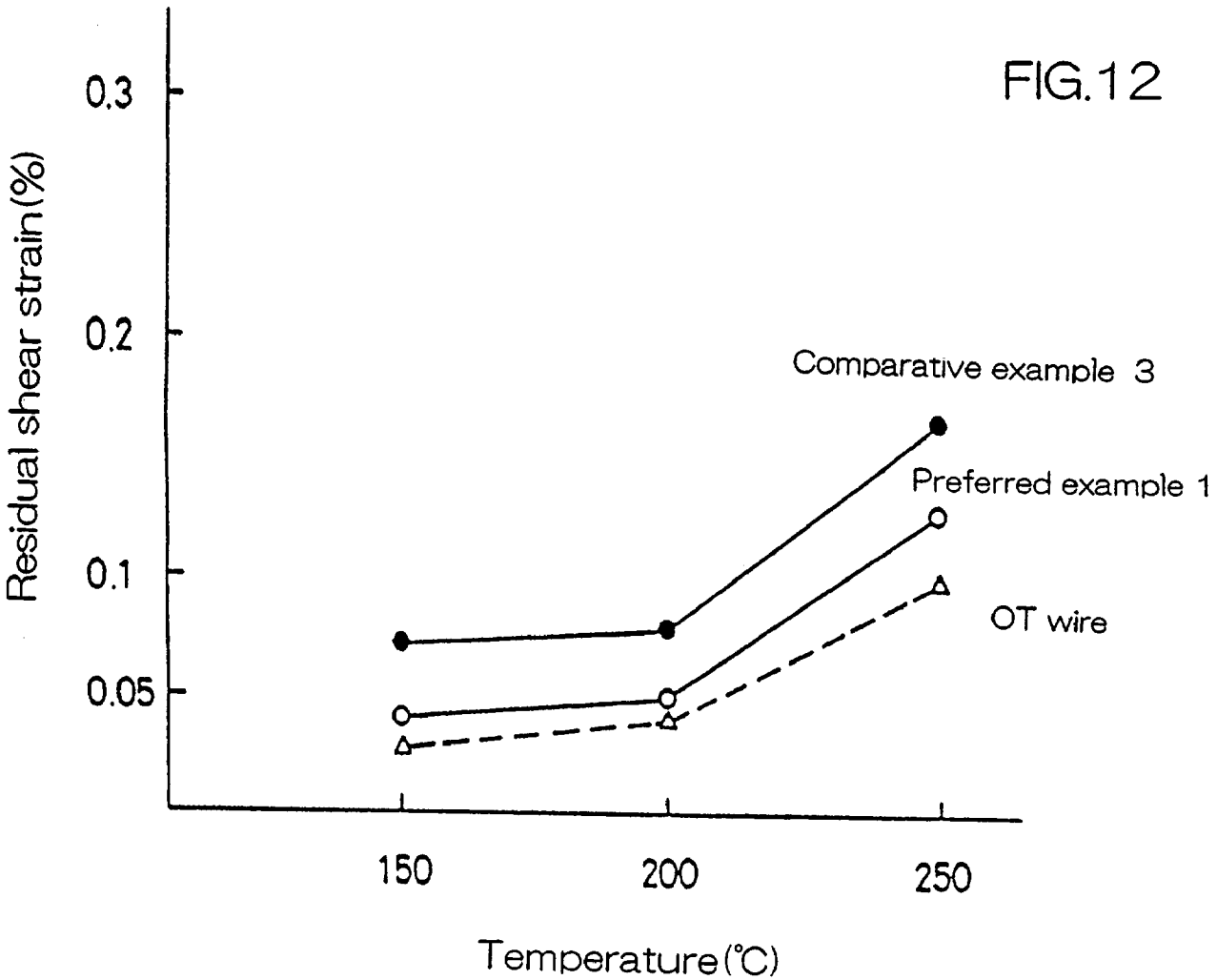
FIG. 12 is a graph showing a relation between temperature environment and residual shear strain.

Then, the preferred example 1, comparative example 3 and OT wire specimens were evaluated for their heat resistance, the result of which is shown in FIG. 12. Heat resistance was evaluated by determining the residual shear strain after being loaded with a torsion stress of 300 MPa for continuous 24 hours. As shown in FIG. 12, the preferred example 1 has almost the same heat resistance as that of OT wire, while the comparative example 3 worked under different drawing conditions exhibits a low heat resistance.

EXPERIMENTAL EXAMPLE 2-4

Figure 13:
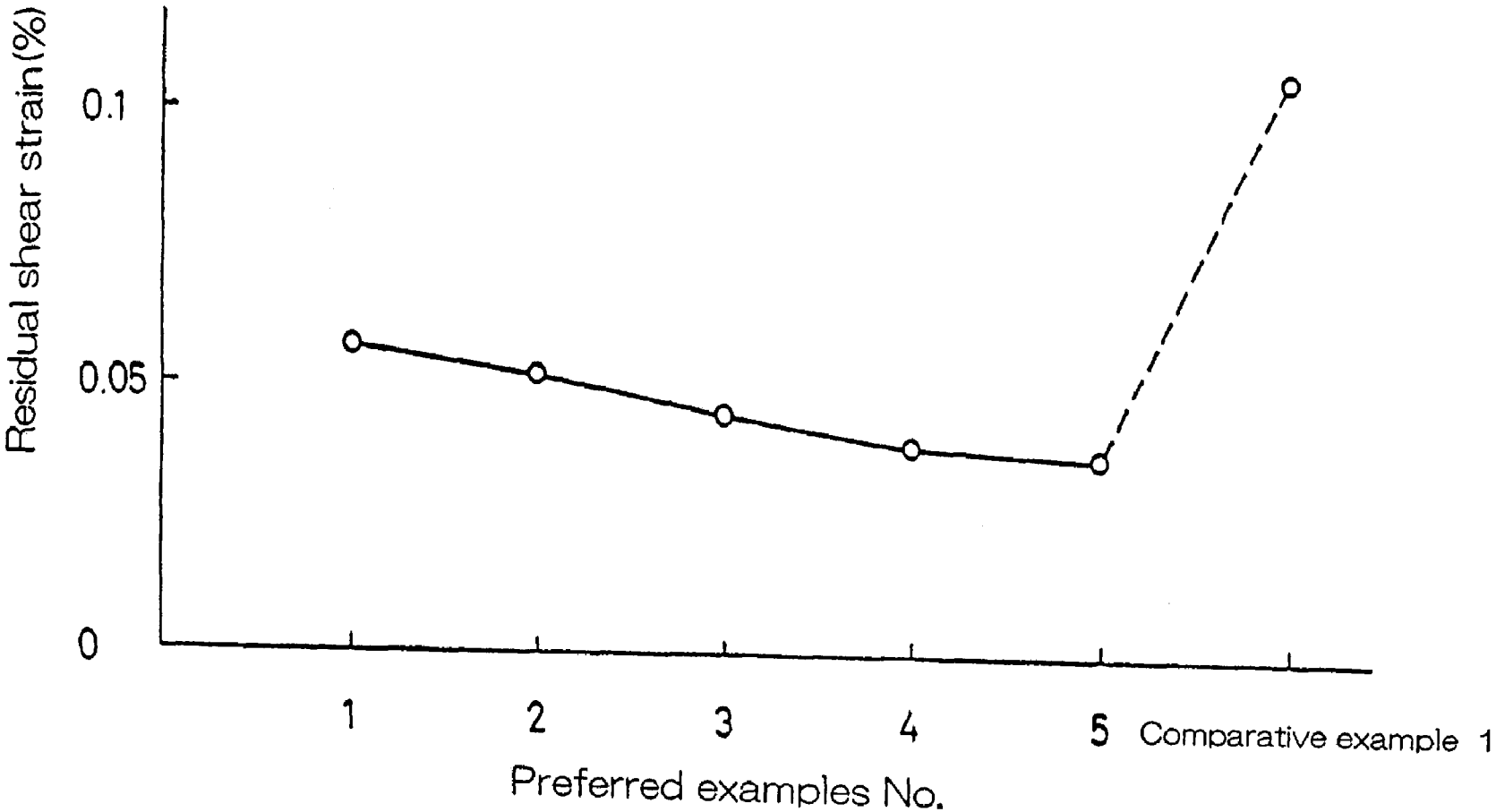
FIG. 13 is a graph showing effects of V, Mo and Al contents on the heat resistance of steel wire.

Using materials having chemical compositions shown in Table 5, steel wires were obtained through working processes similar to those used in the experimental example 2-1. Unlike the experimental example 2-4, however, the heat treatment was applied at 400° C. for 20 minutes. For the comparative evaluation, the comparative example 1 in the experimental example 2-1 was used also in the experimental example. The resultant steel wires were held under stress load of 700 MPa for continuous 24 hours at 200° C. to determine residual shear strain in order to evaluate the heatresistance based thereon. The result of test is shown in FIG. 13. As can be seen on the graph of FIG. 13, the preferred examples 1 through 5 all exhibit a high heat resistance with small residual shear strain. Particularly, the preferred examples 2 through 5 containing V, Mo, and/or Al have a further improved heat resistance as compared other examples not containing such a component.

TABLE 5

| | C | Si | Mn | V | Mo | Al |
|---|---|---|---|---|---|---|
| Preferred example 1 | 0.82 | 0.92 | 0.78 | — | — | — |
| Preferred example 2 | 0.83 | 1.02 | 0.77 | 0.15 | — | — |
| Preferred example 3 | 0.81 | 0.98 | 0.78 | — | 0.10 | — |
| Preferred example 4 | 0.81 | 0.93 | 0.78 | 0.08 | 0.08 | — |
| Preferred example 5 | 0.82 | 0.92 | 0.78 | — | — | 0.21 |
| Comparative example 1 | 0.83 | 0.21 | 0.76 | — | — | — |

(mass %)

For the abovementioned preferred examples 1 through 5, cementite particles were morphologically determined by means of a high-resolution TEM to reveal that the particles all had a thickness of 5-20 nm and that particles 5-20 nm in width are arranged substantially alternately with the particles of 20-100 nm in width. Besides, up to 3 cementite particles falling in the same width range, namely, 5-20 nm range or 20-100 nm range were observed as being successively located. Thus, it is understood that effect of improving the heat resistance may be recognized, even if the cementite particles in one or the other same width rage are disposed in succession to each other, so long such a succession is limited in number of particles up to 3 or so.

However, even a steel wire having a high heat resistance, it cannot withstand conditions of practical use, if its toughness is insufficient. Further, toughness is also important factor for productivity. In this respect, V and Mo contents in a steel wire exceeding 0.15 mass % in total increases the patenting time taken to achieve a required toughness, and difficult in the total for the actual production as for this point, thus having rendered industrial production of such steel wires difficult. According to the present invention, it was also found out that a steel wire containing Al can maintain a satisfactory heat resistance while maintaining an adequate toughness. For example, a wire rod not containing Al will results in a decreased toughness of steel wire in a high-speed drawing, while even at a 50% higher drawing speed a wire rod having an Al content may secure almost the same toughness as that before increasing the speed.

EXPERIMENTAL EXAMPLE 2-5

Figure 14:
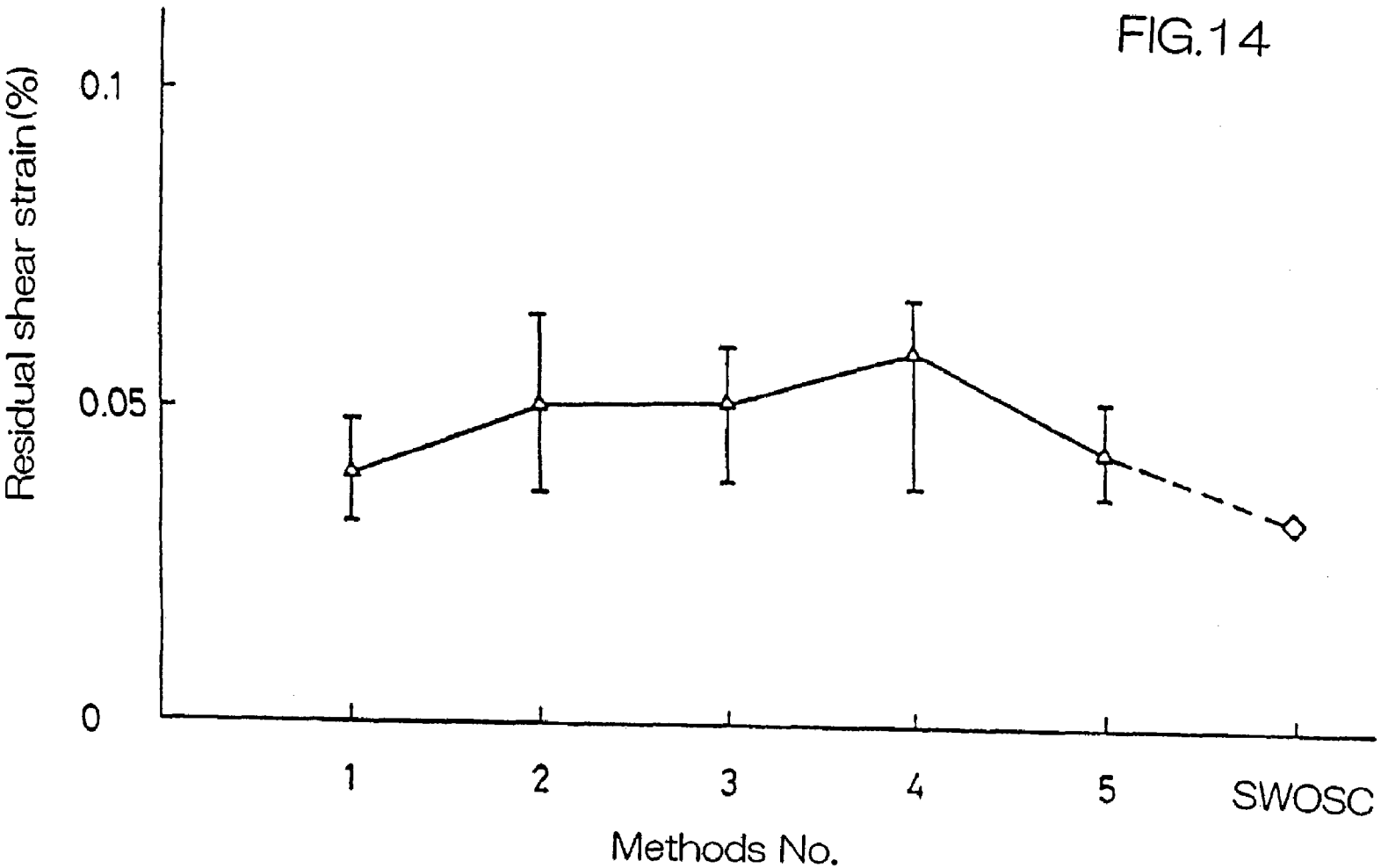
FIG. 14 is a graph showing a result of evaluation of heat resistance in steel wires produced by varied drawing methods.

Except that the drawing conditions were changed as shown in Table 6, the same process steps as those used in the experimental example 2-1 were repeated to produce steel wires. In this case, however, the heat treatment was applied at 380° C. for 20 minutes. As in the foregoing experimental example 2-1, the torsion in process is given as amount of torsion per 100 mm steel wire length. The heat resistance was evaluated for each of the steel wire obtained by the corresponding method shown in Table 6. Heat resistance was evaluated by determining the residual shear strain after the specimen being loaded with a torsion stress of 500 MPa at 200° C. for continuous 24 hours. In addition, OT wires (SWOSC) were evaluated for a comparison purpose. For each method, 5 specimens were prepared, with the average of and variation in residual shear strains determined being given on the graph of FIG. 14. While any of these methods brought forth a satisfactory result, the specimens of methods 1 and 5 a particularly good result with a minimized variation.

TABLE 6

| | Working ratio | Drawing direction turnover | Torsion in process |
|---|---|---|---|
| Method 1 | True strain: 0.15–0.25 | Once at 7 mm ϕ | Within 15° |
| Method 2 | True strain: 0.15–0.25 | None | Within 15° |
| Method 3 | True strain: 0.15–0.25 | Once at 7 mm ϕ | 45° in last pass |
| Method 4 | True strain: 0.15–0.25 except 0.08 in last pass | Once at 7 mm ϕ | Within 15° |
| Method 5 | True strain: 0.15–0.25 | Once at 10 mm ϕ and 6 mm ϕ each | Within 15° |

EXPERIMENTAL EXAMPLE 2-6

Figure 15:
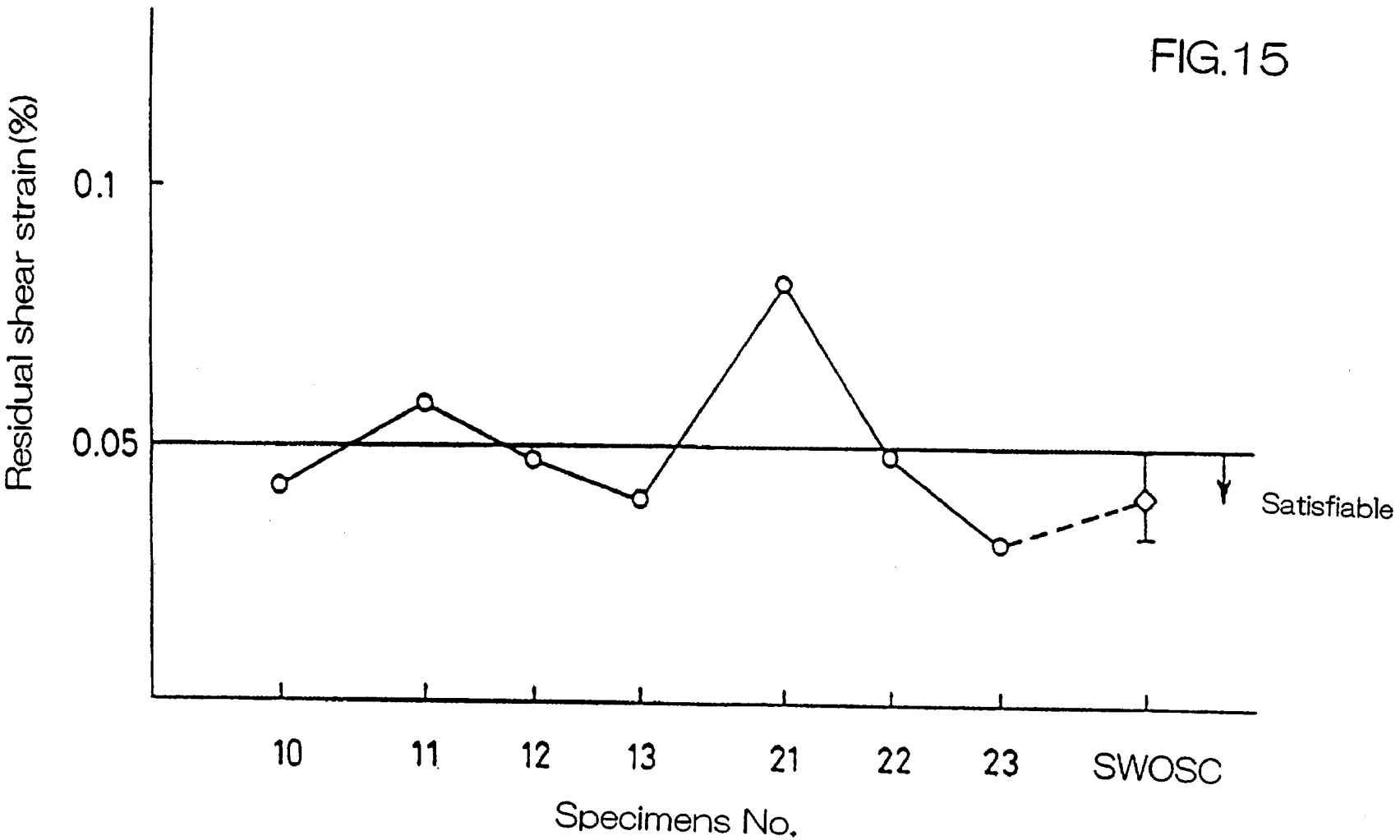
FIG. 15 is a graph showing a relation between temperature environment and residual shear strain of materials having varied chemical compositions.

Using materials having chemical compositions as shown in Table 7, the same process steps were repeated as in the foregoing experimental example 2-1 were repeated to prepare steel wire specimens 10 through 14 and 21 through 24. As a result, the specimens 14 and 24 were turned out to be unfavorable for industrial production because of low yields in the manufacturing processes of steel wire, particularly, at stages succeeding to the casting step. Therefore, the remaining specimens 10, 13, 21 and 23 were evaluated for their heat resistance. Heat resistance was evaluated by determining the residual shear strain after the specimen being loaded with a torsion stress of 600 MPa at 190° C. for continuous 24 hours. In addition, OT wires (SWOSC) were evaluated for a comparison purpose. The result of evaluation is shown in FIG. 15. As can be seen in FIG. 15, except the specimen 21 with a lower Si content, all specimens exhibited a satisfactory result.

TABLE 7

| | C | Si | Mn |
|---|---|---|---|
| Specimen 10 | 0.82 | 0.92 | 0.78 |
| Specimen 11 | 0.72 | 0.88 | 0.81 |
| Specimen 12 | 0.77 | 0.87 | 0.83 |
| Specimen 13 | 0.95 | 0.91 | 0.77 |
| Specimen 14 | 1.05 | 0.93 | 0.76 |
| Specimen 21 | 0.82 | 0.38 | 0.75 |
| Specimen 22 | 0.83 | 0.57 | 0.77 |
| Specimen 23 | 0.84 | 1.37 | 0.76 |
| Specimen 24 | 0.81 | 1.59 | 0.78 |

(mass %)

EXPERIMENTAL EXAMPLE 2-7

Figure 16:
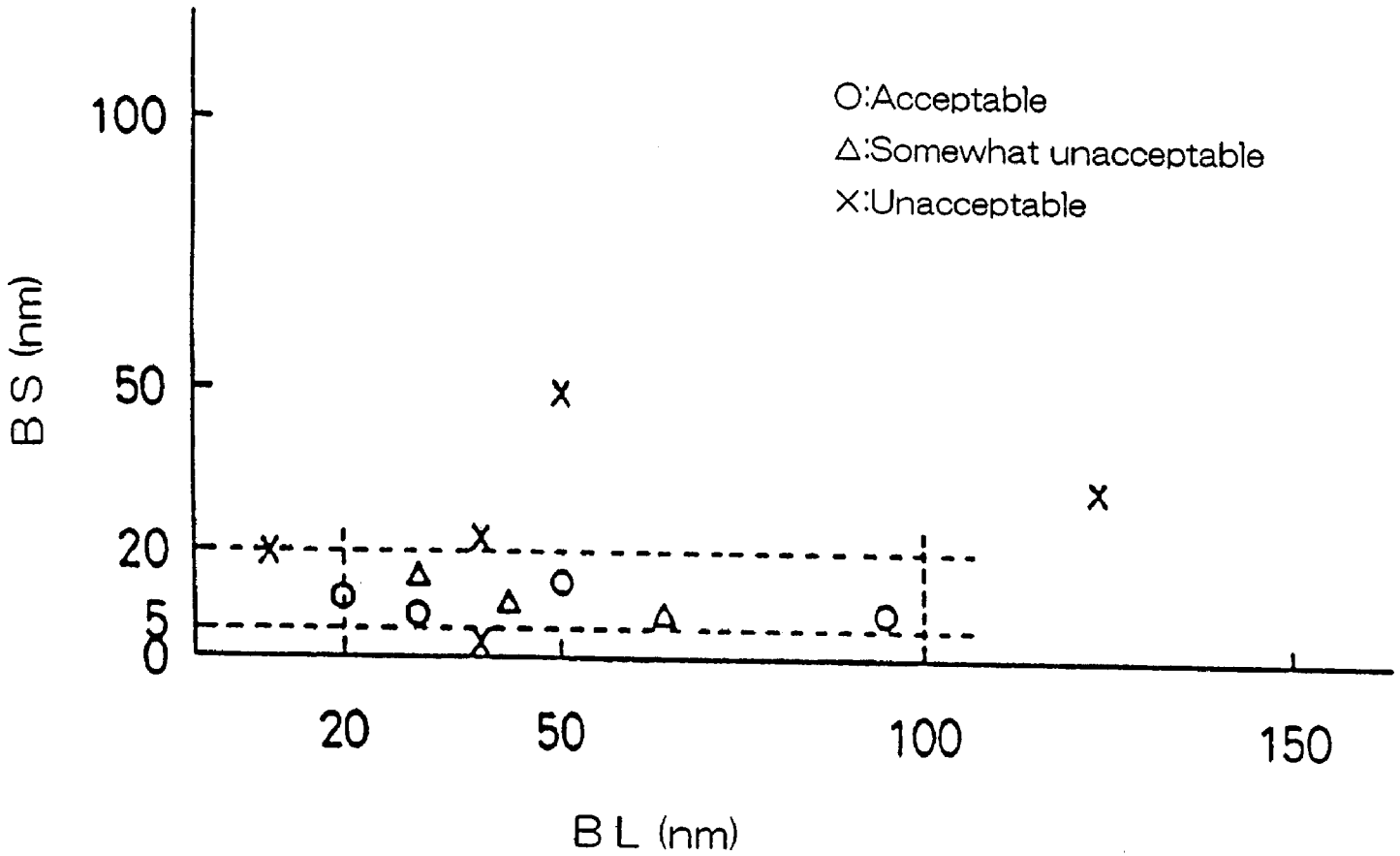
FIG. 16 is a graph showing a relation between the length of cementite structure and the heat resistance of steel wire.

A material specimen 31 containing 0.79 mass % of C, 0.80 mass % of Si, and 0.28 mass % Mn was prepared and worked into steel wire specimens through the same process steps as in the aforementioned experimental example 2-1 except the drawing conditions changed therefrom. In the cementite structure of the resultant steel wire, although longer particles of oval shape were arranged substantially alternately with shorter particles of almost round shape like the case shown in FIG. 10, the both types of particle varied widely in length, and then a relation between the particle length and heat resistance was analytically determined. The length BL of the oval-shaped longer particles and the length BS of the generally round-shaped shorter as shown in FIG. 10 were measured, and the residual shear strain was determined after the specimen being loaded with a torsion stress of 600 MPa at 190° C. for continuous 24 hours in order to find a relation between the particle length and heat resistance. The result is given on the graph of FIG. 16. As to the basis of acceptability in evaluation here, "acceptable" means that the residual shear strain was 0.06% or below almost equivalent to the level of OT wires (SWOC). As can be seen on the graph of FIG. 16, it is understood that a range defined by approximately $20 \leqq BL \leqq 100$ nm and $5 \leqq BS \leqq 20$ nm may give a satisfactory result.

Figure 17:
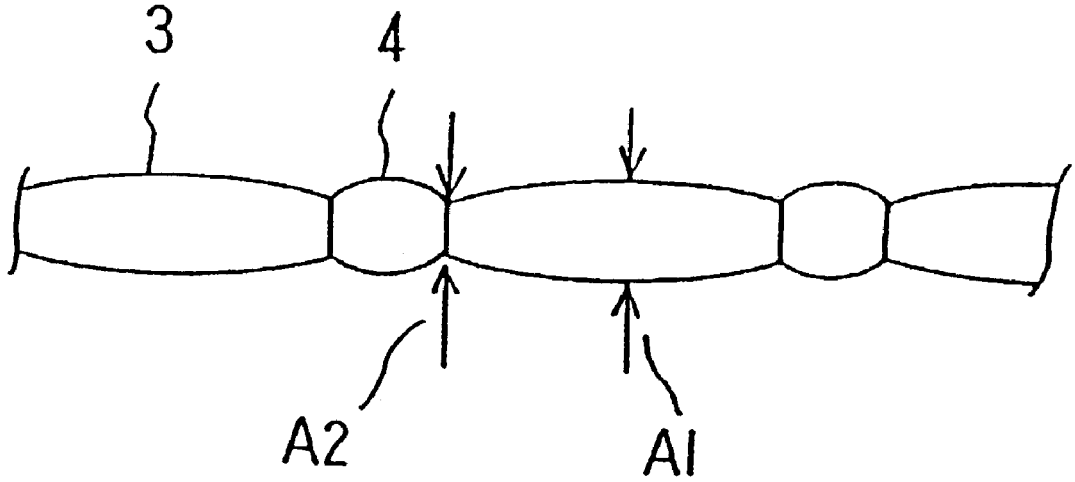
FIG. 17 is a diagrammatic drawing illustrating a morphological representation of cementite structure.

However, since even those particles having a length within the range of $20 \leqq BL \leqq 100$ nm and $5 \leqq BS \leqq 20$ nm occasionally resulted in an evaluation as "somewhat unacceptable", the cementite structure was further analyzed in detail. As shown in FIG. 17, in this analysis, a ratio of the thickness A1 of cementite particles 3 with the size of 20-100 nm in width vs. the thicknesswise length A2 of those portions of adjacent cementite particles 4 contacting the former cementite particles 20-100 nm wide was determined for evaluation of the cementite structure. Consequently, it was found that cementite structures having a ratio defined by $0.3 < A2/A1 < 0.95$ might give an "acceptable" result, while those having a ration outside that range giving an "somewhat unacceptable" result.

EXPERIMENTAL EXAMPLE 3-1

Spring steel wire specimens having chemical compositions shown in Table 8 were prepared and evaluated for their properties. For preparing the specimens, steel species having the aforementioned chemical compositions were first melt-cast in a vacuum melting furnace and then subjected to hot forging and rolling to be worked into wire rods of 11 mmϕ. Among the resultant wire rods, all specimens except for 1-1 had their surfaces shaved. Those wire rod of 11 mmϕ were subjected to patenting to obtain a pearlite structure. For all specimens, the patenting was performed by heating at 950-980° C. and treating in a lead bath at 580° C. The specimens 1-1, 1-2, and 1-4 took about 15 seconds to achieve pearlite transformation, while the specimens 1-3 and 1-5 took much time as long as 30-60 seconds showing an inferiority in productivity. The thus worked and treated wire rods were then drawn down to 6 mmϕ to be worked into spring steel wire specimens. The die used for the drawing process was set at an die angle of 10-8 and bearing length of d/4-d/5 (d representing a die diameter).

TABLE 8

| Specimen | C | Si | Mn | Cr | Ni | Note |
|---|---|---|---|---|---|---|
| 1-1 | 0.82 | 0.99 | 0.81 | 0.09 | 0.015 | Preferred example |
| 1-2 | 0.82 | 0.21 | 0.79 | 0.06 | — | Prior art piano wire |
| 1-3 | 0.81 | 0.98 | 0.78 | 0.49 | — | Heat-resistant piano wire 1 |
| 1-4 | 0.81 | 0.98 | 0.78 | — | — | Heat-resistant piano wire 2 |
| 1-5 | 0.56 | 1.39 | 0.71 | 0.72 | — | Hard-drawn Si-Cr steel wire |

(mass %)

After drawing, the steel wires was straightened and then bent into a U shape in order to proceed to evaluation of thermal permanent set resistance. As shown in FIG. 18, each U-shaped steel wire specimen had its one end A, right-angle bends B and C fixed, and its other end D lifted to and held at a position indicated at D' by an angle θ at the bend C, so that a torsion stress was applied to the B-C portion of the steel wire specimen. Each specimen as fixed with a jig at this position was placed in a furnace and after being heated therein at a predetermined temperature kept for a predetermined time, had its jig removed at a room temperature, and its residual shear strain was determined. Before being applied with torsion and fixed with jig, each U-shaped specimen was subjected to strain relief annealing at 350° C. for 30 min.

Figure 19:
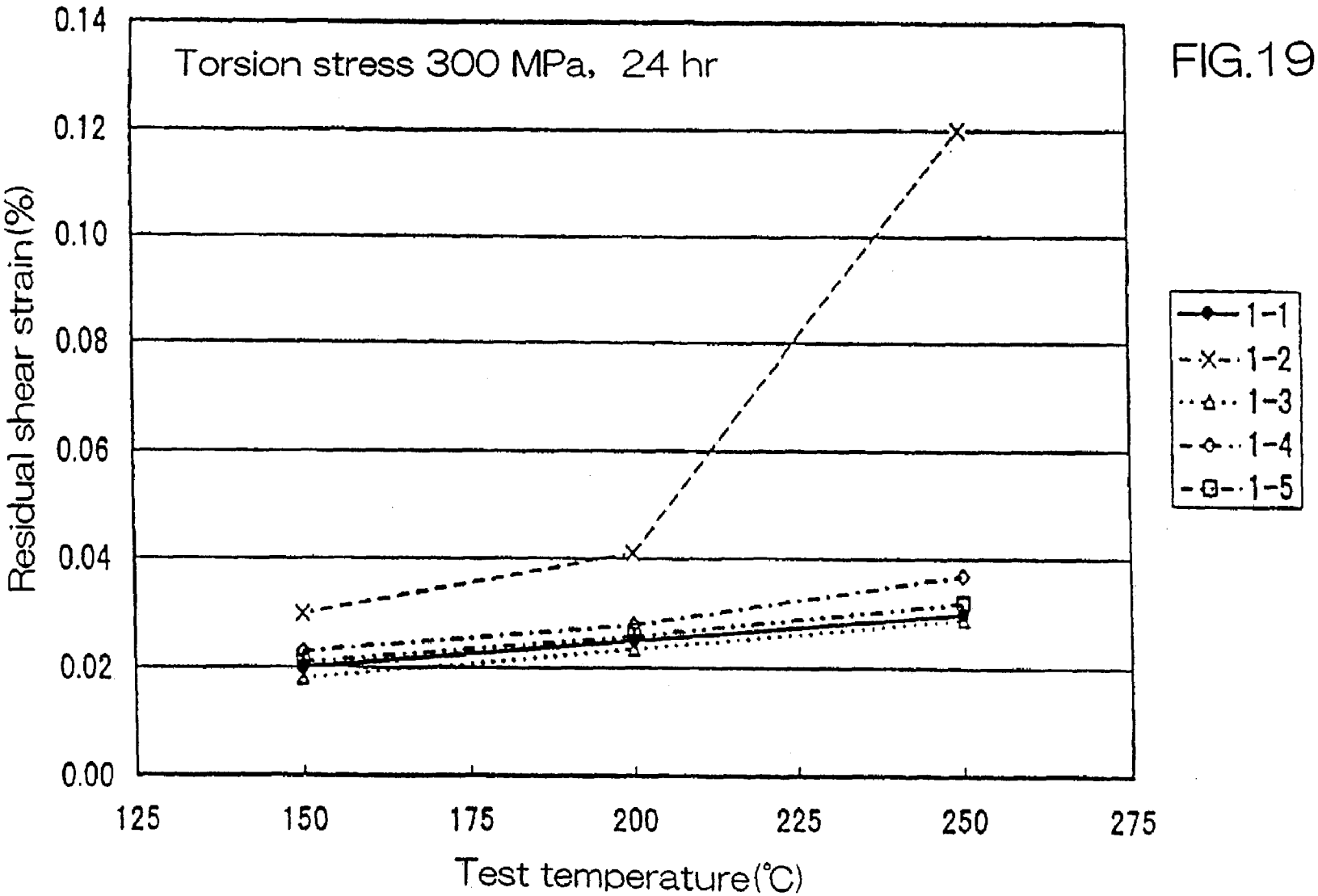
FIG. 19 is a graph showing a result of thermal permanent set resistance test under a low stress-short duration condition.
Figure 20:
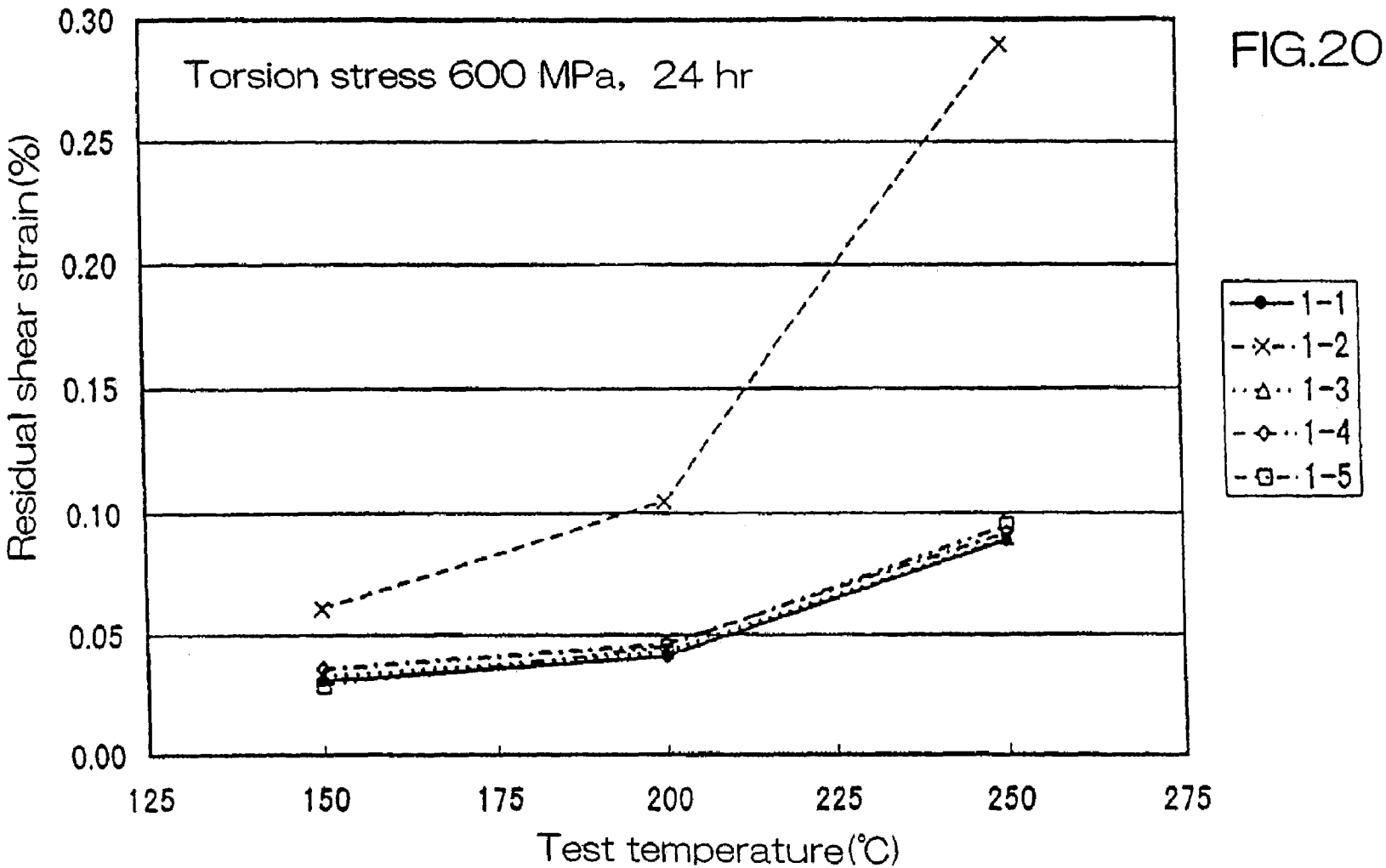
FIG. 20 is a graph showing a result of thermal permanent set resistance test under a high stress-short duration condition.
Figure 21:
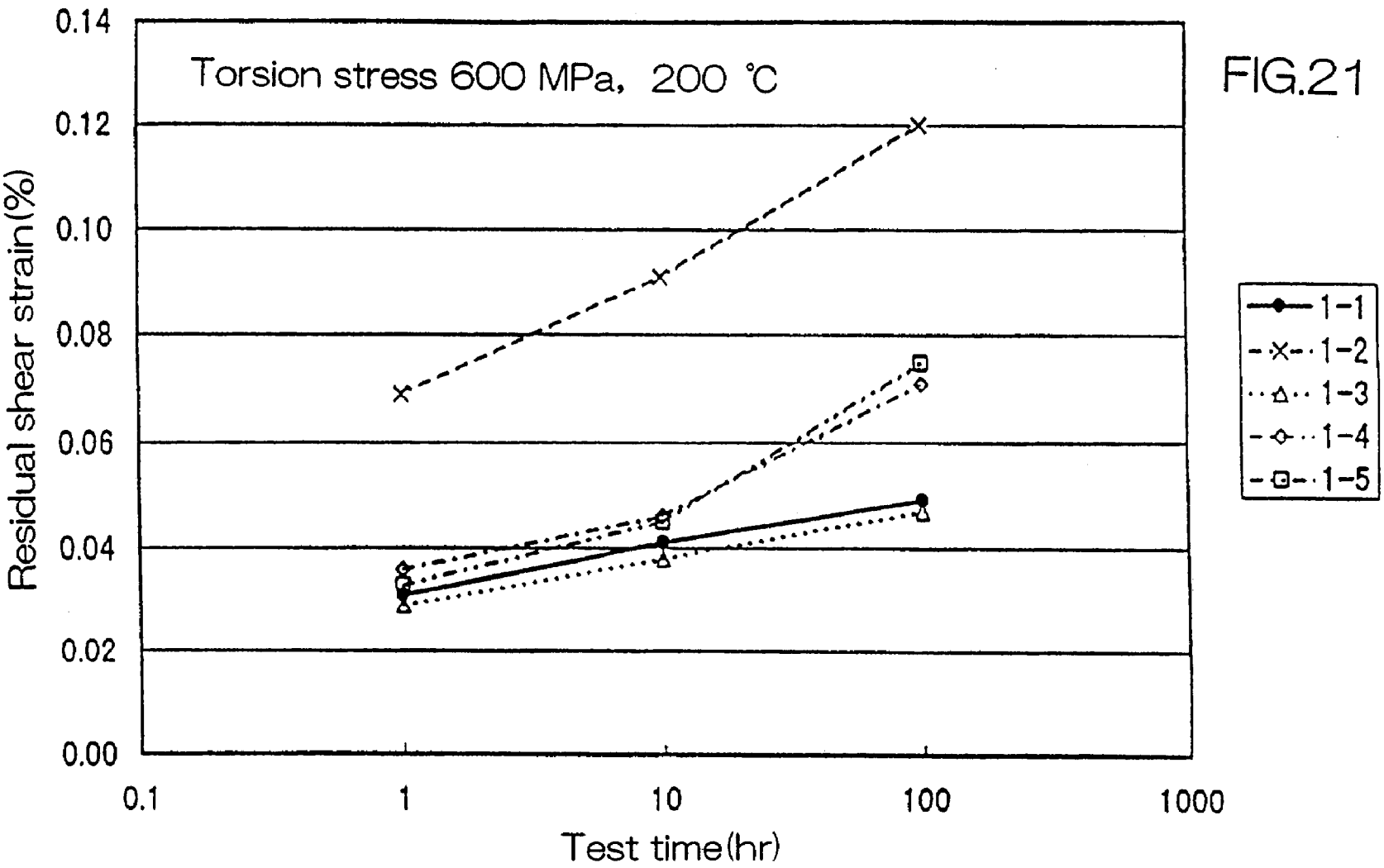
FIG. 21 is a graph showing a result of thermal permanent set resistance test under a high stress-long duration condition.

As an example representing a low stress-short duration condition, result of a test conducted under 300 MPa torsion stress held for 24 hours is shown in FIG. 19, while result of another test conducted, as an example representing a high stress-short duration condition, under 600 MPa torsion stress held for 24 hours is shown in FIG. 20, and result of a further test conducted, as an example representing a high-stress-long duration condition, under 600 MPa torsion stress held for 24 hours at 200° C. is in FIG. 21.

In all tests, the specimen 1-2 representing the prior art piano wire exhibited a low heat resistance, while other specimens all had an almost equal heat resistance. The specimen 1-2 which is a usual piano wire in the case of which as well is inferior to heat resistance, and it is understood that heat resistance is about equal except for it. In particular, the results of evaluation on the specimen 1-2 and on remaining specimens exhibited a larger discrepancy as the higher temperatures and stresses got involved.

Figure 22:
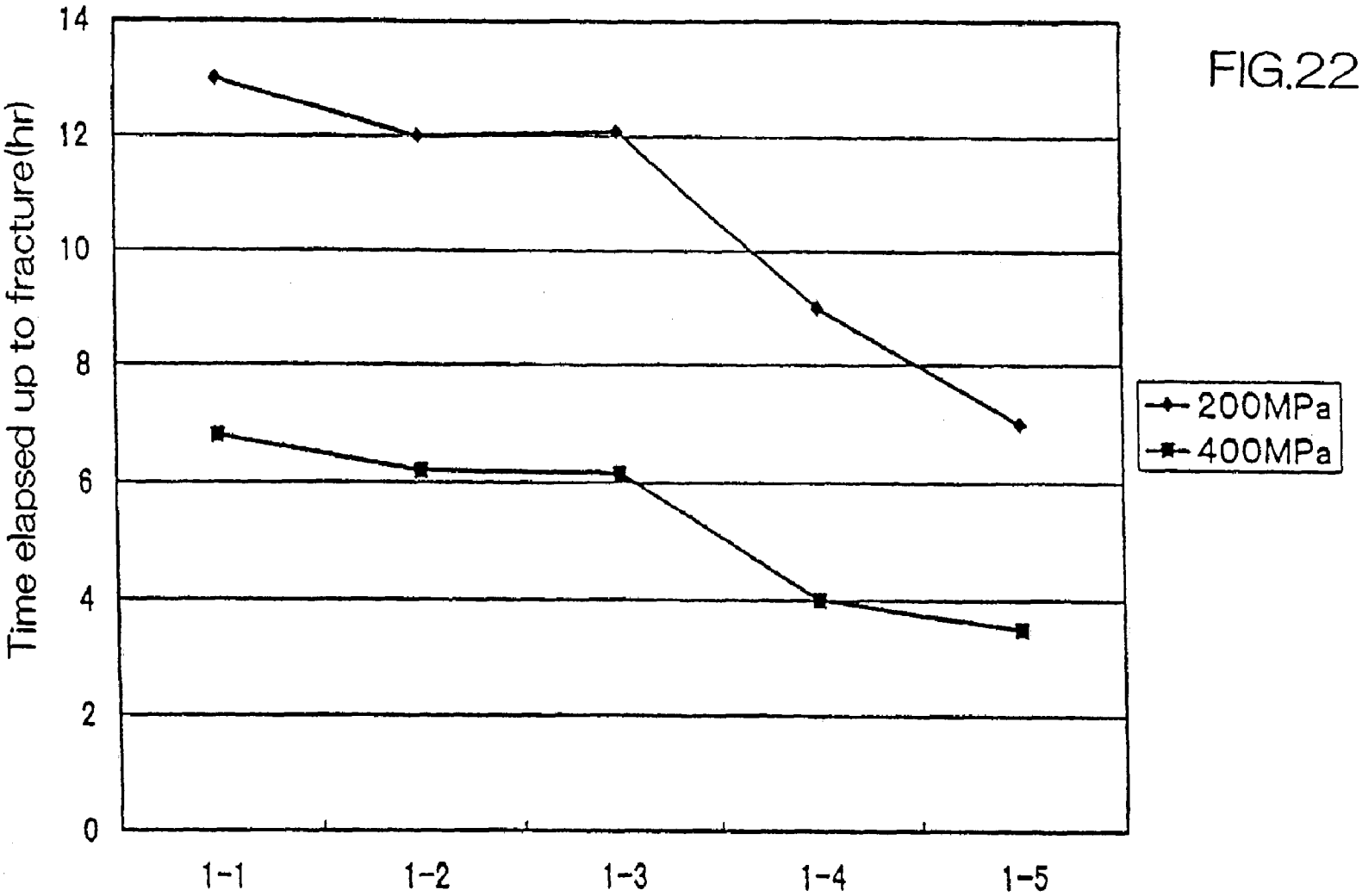
FIG. 22 is a graph plotting delayed fracture properties.

Then, the specimens were evaluated their delayed fracture properties. The specimen after being twisted as described above with reference to FIG. 18 was immersed in a 20% ammonium thiocyanate solution at 50° C., and the time elapsed before the specimen fractured was measured. Torsion stresses applied were 200 MPa and 400 MPa. The result is shown in FIG. 22. As can be seen in FIG. 22, it is understood that the specimens 1-4 and 1-5 early underwent a delayed fracture, while remaining specimens exhibited satisfactory delayed fracture properties with a longer time elapsing up until fracture. Additionally, when specimens of Si—Cr steel oil tempered steel wire were evaluated for its heat resistance under the same conditions as above, the specimens fractured within 30 minutes under any stresses.

Based on the test results obtained as above, how the respective specimens satisfy the previously described formulas (4) and (5) was determined, result of which is given in Table 9 below along with the result o evaluation regarding the productivity (patenting time).

TABLE 9

| Specimen | Formula 4 | Formula 5 | Productivity (patenting time) |
|---|---|---|---|
| 1-1 | ○ | ○ | ○ |
| 1-2 | X | ○ | ○ |
| 1-3 | ○ | ○ | X |
| 1-4 | Δ | Δ | ○ |
| 1-5 | Δ | X | X |

○: Formula is satisfied.
X: Formula is not satisfied.
Δ: Formula is satisfied sometimes, but sometimes not From these results, the specimen 1-1 representing a preferred example of the present invention are excellent in heat resistance, delayed fracture properties and productivity, while the specimens 1-3 and 1-5 will result in lower productivity, and the specimen 1-2 has a lower heat resistance, with the specimens 1-4 and 1-5 exhibiting inferior delayed fracture properties.

Out of the specimens described above, the specimen 1-1 was analyzed for its distribution of hardness and chemical composition. As a result, the variation in Vickers hardness in a region up to D/4 deep from the wire surface had its maximum and minimum within 15% of its average, where D representing the wire diameter. Further, the Si content in a region in the ferrite layer within 5 mm from its interface with the cementite layer was within 1.6 times the average Si content in the ferrite layer. Thus, it is supposed that such a distribution of hardness and chemical composition may act to relieve the strain at the ferrite-cementite interfaces and provide an adequate heat resistance.

Further, materials of the above-described respective specimens were actually worked into springs in order to evaluate the properties defined by the formulas (4) and (5) from a viewpoint of their practical effectiveness.

In the first place, for determining the heat resistance at around 200° C. as a heat resistance test, specimens were loaded with 0 and 500 MPa torsion stresses alternately in 100 times of repetition at 180° C. 200° C., and 220° C., respectively, and residual shear strains were measured after the specimens being load with stresses. When evaluated on the basis that a 0.05% or smaller residual shear strain represents an acceptable spring wire, only the specimens 1-1 and 1-3 satisfied this standard, so that the formula (4) could be determined as having a proper adequacy.

Then, after cationically coating the specimens in an ordinary manner for the purpose of corrosion resistance, the specimens were loaded with and kept under 600 MPa compression force. As a result, the specimens 1-4 and 1-5 broke within 200 hours, while the specimens 1-1, 1-2, and 1-3 did not break even when kept under load for 200 hours or longer, showing their superiority in delayed fracture properties as well and thus proving the proper adequacy of the formula (5).

EXPERIMENTAL EXAMPLE 3-2

The foregoing specimen 1-1 was evaluated for its heat resistance and delayed fracture properties by varying the Ni content. Specimens 2-1 through 2-5 based on the specimen 1-1 had chemical compositions as shown in the table 10.

TABLE 10

| Specimen | C | Si | Mn | Cr | Ni |
|---|---|---|---|---|---|
| 2-1 | 0.82 | 0.99 | 0.81 | 0.09 | 0.015 |
| 2-2 | 0.82 | 0.92 | 0.79 | 0.06 | 0.13 |
| 2-3 | 0.81 | 1.01 | 0.80 | 0.07 | 0.81 |
| 2-4 | 0.82 | 1.02 | 0.80 | 0.10 | 1.23 |
| 2-5 | 0.81 | 0.99 | 0.81 | 0.10 | 0.005 |

(mass %)

Figure 23:
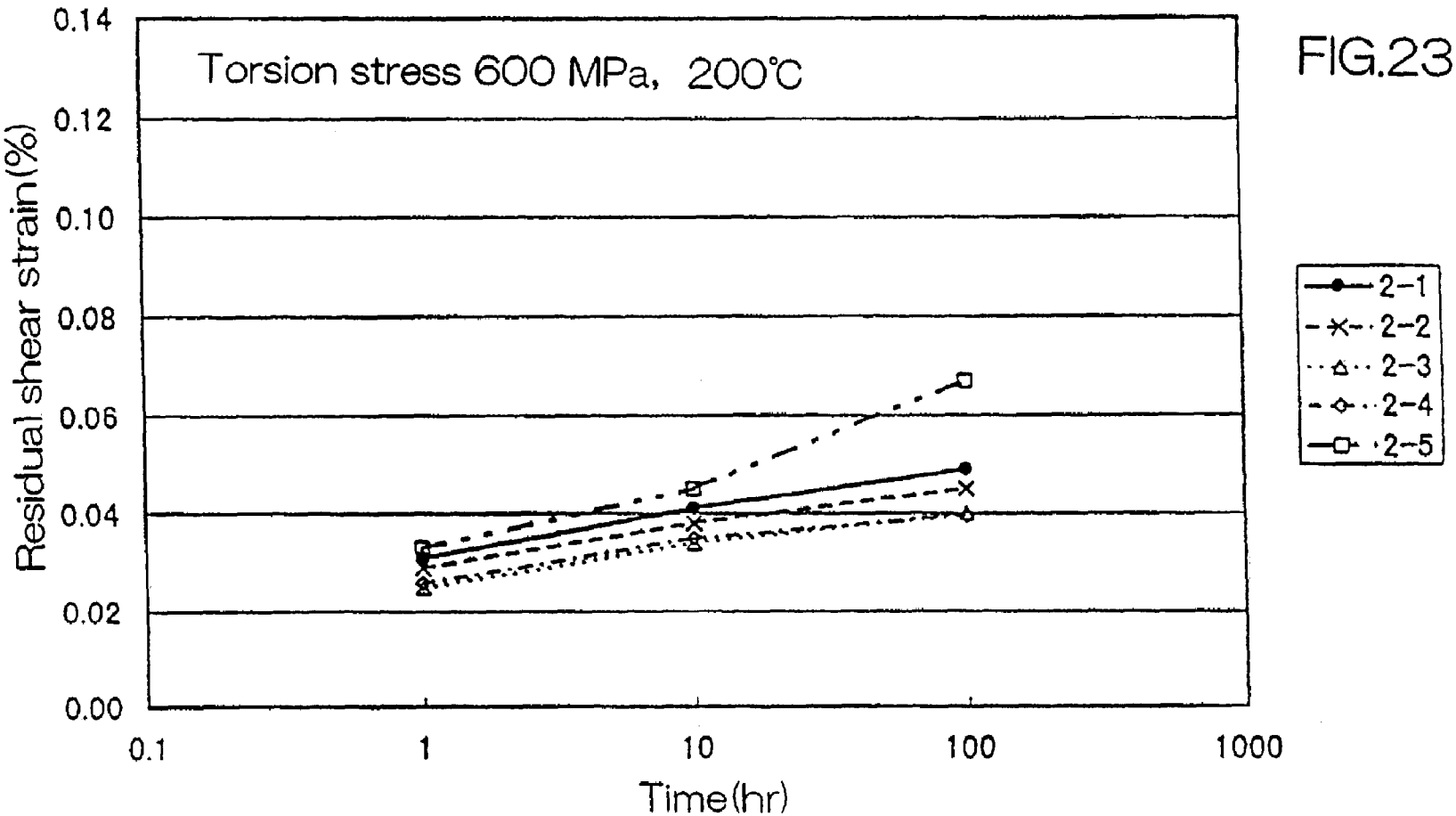
FIG. 23 is a graph showing a result of thermal permanent set resistance test on steel wires having varied Ni contents.
Figure 24:
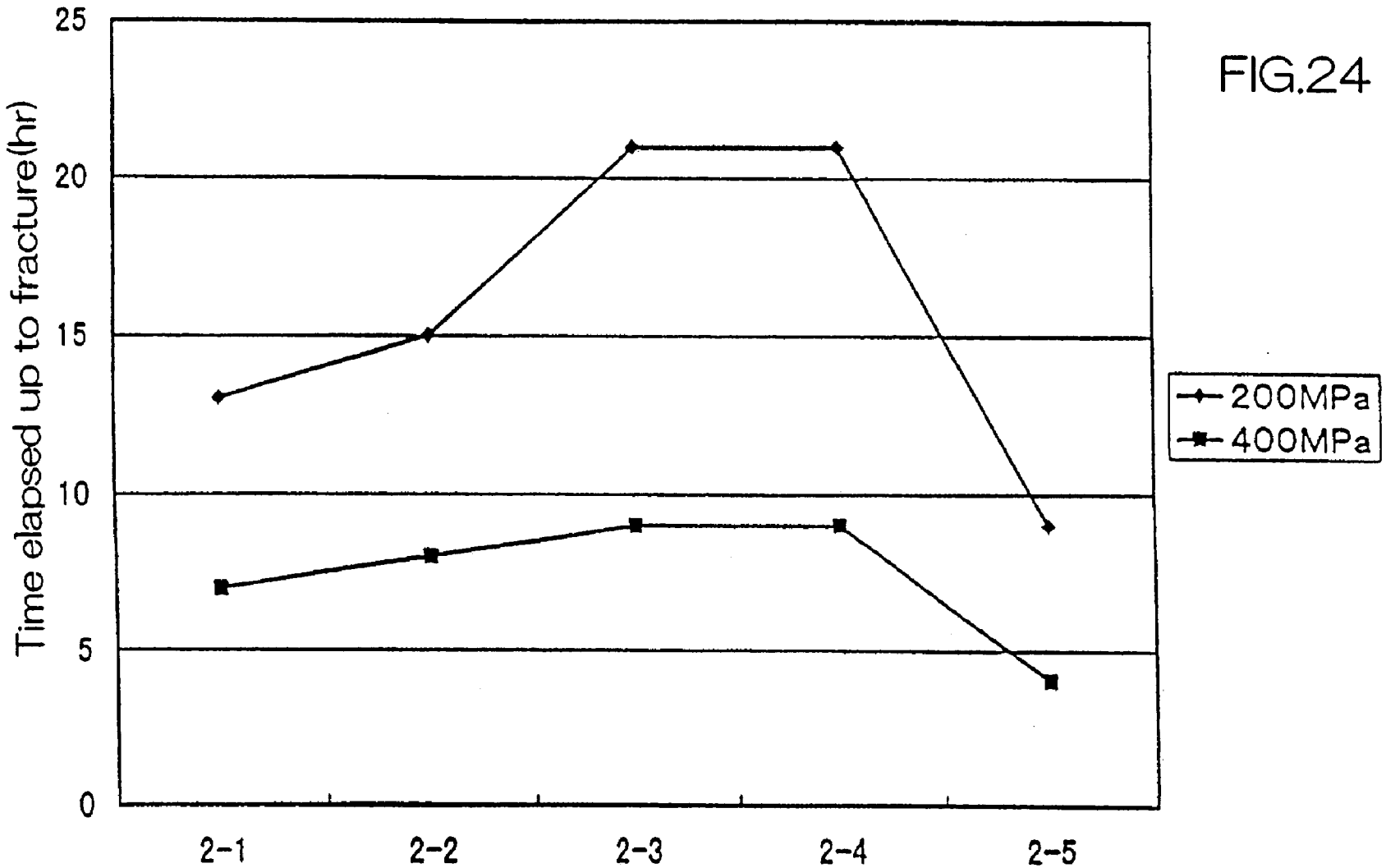
FIG. 24 is a graph showing a result of delayed fracture test on steel wires having varied Ni contents.

Heat resistance was evaluated by measuring residual shear strains in a thermal permanent set resistance test as previously described in the experimental example 3-1, under conditions of 600 MPa torsion stress kept for 1, 10 and 100 hours, respectively, at 200° C. Additionally, delayed fracture test was conducted in the same method as in the experimental example 3-1, using 2 stress loads of 200 MPa and 400 MPa The results of the heat resistance test and the delayed fracture test are shown in FIGS. 23 and 24.

The specimen 2-5 having an extremely low Ni content exhibited inferior fracture properties and a low heat resistance with a large residual shear stress.

While, the specimen 2-3 and 2-4 having a high Ni exhibited satisfactory delayed fracture properties. However, it is understood that the Ni content of the specimen 2-3 is sufficient for this purpose, because the two specimens 2-3 and 2-4 have little difference in properties and a higher Ni content as in the specimen 2-4 adds to the cost. The specimens 2-1, 2-2, and 2-3 also exhibited a high heat resistance and satisfactory delayed fracture properties in a well-balanced manner in view of cost as well.

EXPERIMENTAL EXAMPLE3-3

Materials having the chemical compositions of the foregoing specimen 1-1 was subjected to patenting like the experimental example 3-1 and then steel wire specimens were prepared from the patented product through a drawing process with a working ratio of 60-94% as combined with a strain relief annealing process at 250-450° C., and the lattice distorsion of ferrite particles in pearlite structures after annealing was measured. An X-ray diffraction method was used for the measurement, and the measurement result was analyzed by Willson method. Since the specimens involved many errors in their surfaces, measurement was made on their vertical sections, after the vertical sections being lapped and then electro polished by at least 50 μm to sufficiently remove strains caused by lapping.

Figure 25:
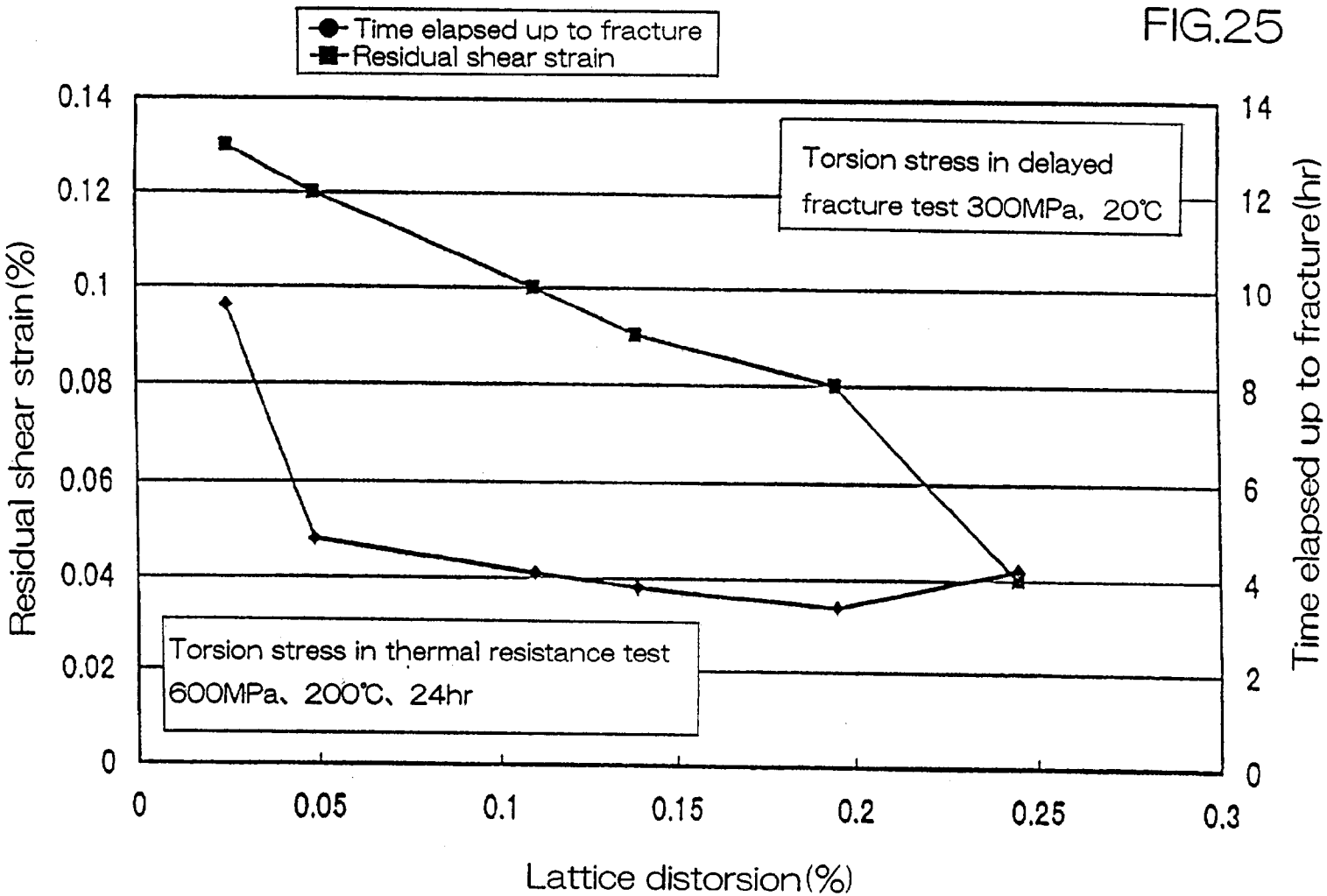
FIG. 25 is a graph showing results of heat resistance test and delayed fracture properties.

Further, the specimens were also tested for their heat resistance and delayed fracture properties. For thermal permanent set resistance properties, a residual shear strain was measured under conditions of a 600 MPa torsion stress kept loaded for 24 hours at 200° C., and delayed fracture properties were measured by using a torsion stress 300 MPa. A relation between the thus measured lattice distorsion versus heat resistance and versus delayed fracture properties are given on the graph of FIG. 25. As shown by the graph of FIG. 25, it is recognized that a lattice distorsion satisfying both the conditions of the residual shear strain being 0.05% or below and the delayed fracture properties being 8 hours or longer be in the range of 0.05-0.2%.

EXPERIMENTAL EXAMPLE 3-4

Figure 26:
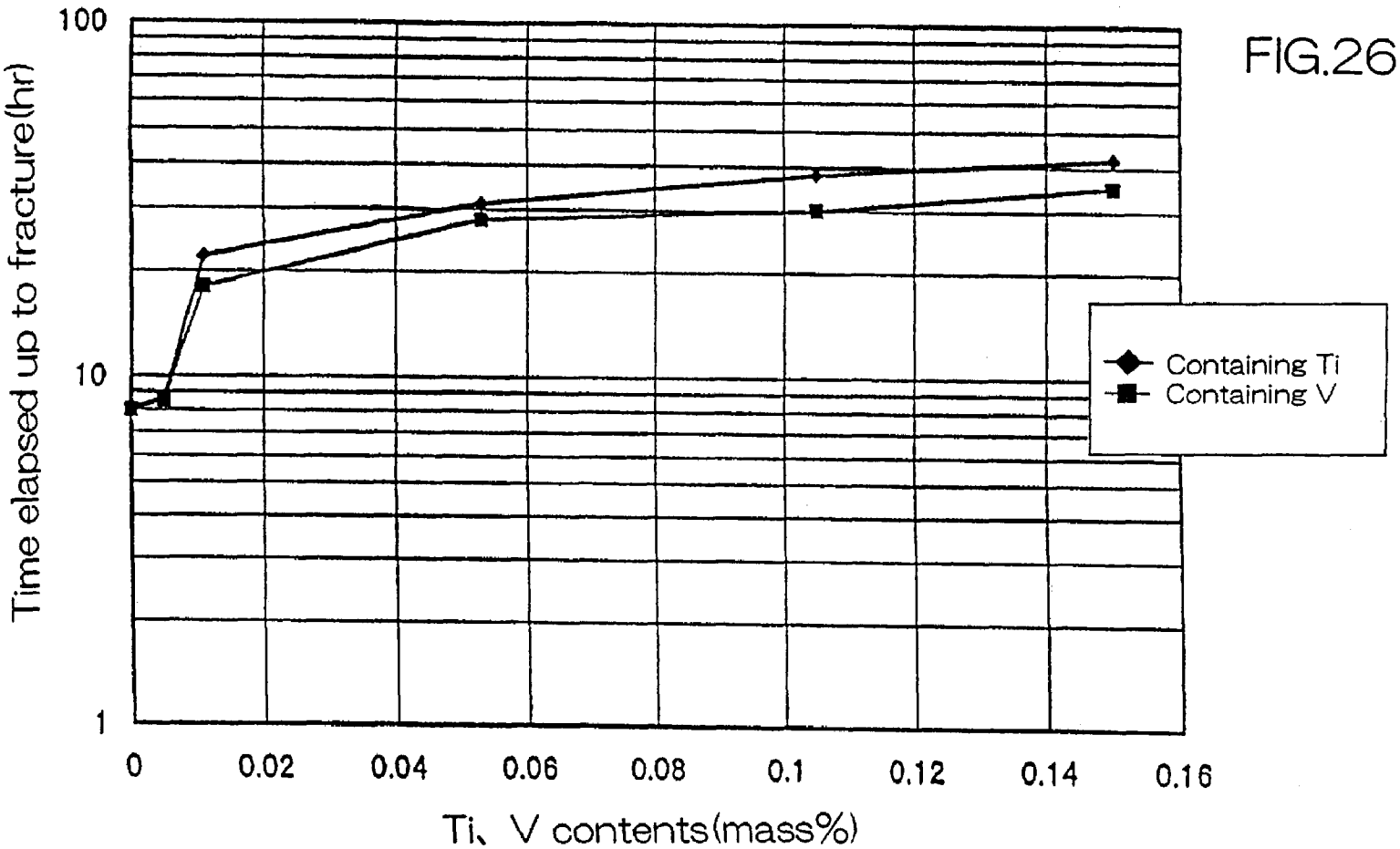
FIG. 26 is a graph plotting a change in thermal permanent set resistance properties with Ti and V contents.

Based on the chemical compositions of the previously described specimen 1-1, specimens additionally containing Ti and/or V were prepared in the like processes as in the foregoing experimental example 3-1, and the resultant specimens were evaluated for their heat resistance and delayed fracture properties. The specimens contained 0.82 mass % of C, 1.0 mass % of Si, 0.8 mass % of Mn, 0.1 mass % of Cr, 0.1 mass % of Ni, 0-0.15 mass % of Ti, and 0-0.15mass % of V. The same method as in the experimental example 3-1 was used for evaluation of heat resistance and delayed fracture properties (with 300 MPa torsion stress). As a result, the presence or content of Ti and/or V made no significant difference in respect of heat resistance. On the other hand, it is understood, as shown in FIG. 26, that addition at least one of Ti and V is effective in improving the delayed fracture properties. However, it was observed that Ti and/or V content exceeding 0.15 mass % decreased wire drawability and post-drawing toughness, thus lowering a practicability as spring steel wires.

EXPERIMENTAL EXAMPLE 4-1

Specimens having chemical compositions (in mass %) shown in Table 11 were melt-cast and the cast material was then hot-forged and hot-rolled, followed by pre-drawing and then patenting of the drawn products. Further, the patented products were subjected to a cold thinning process to be worked into steel wire specimens. The resultant steel wire specimens were subjected to fatigue test and further to lattice distorsion measurement by X-ray diffraction. The lattice distorsion was measured by a method described before (the same method being used in experimental examples 4-2 through 4-4 to be described later).

TABLE 11

| | Chemical compositions | | | |
|---|---|---|---|---|
| | C | Si | Mn | Cr |
| Prior art specimen | 0.82 | 0.21 | 0.51 | 0.05 |
| Inventive specimen 1 | 0.80 | 0.89 | 0.28 | 0.11 |
| Inventive specimen 2 | 0.80 | 1.21 | 0.22 | 0.13 |
| Comparative specimen 1 | 0.81 | 1.87 | 0.25 | 0.12 |
| Comparative specimen 2 | 0.80 | 0.05 | 0.32 | 0.12 |

(mass %)

After hot rolling, the specimens had a 5.5 mmϕ size, and 3.6 mmϕ size after pre-drawing. The patenting temperature was set at 570+(Si content (mass %)×30)° C. Further, the cold working was accomplished by hole-die drawing. The drawing conditions of the inventive specimens and comparative specimens included an 8 die approach angle and 18-15% area reduction ratio per process step. Additionally, the drawing was performed in a single takeup reel at the speed of 10 m/min., and the wire drawing direction as the wire comes out of the die outlet to reach the takeup reel was controlled within 0.5. After being drawn down from 3.6 mmϕ to 1.6 mmϕ under above-described conditions, the wires were straightened and heat-treated. This heat treatment was carried out at 350-450° C. for 20 minutes. For both the inventive specimens and the comparative examples, process conditions were identical excepting their chemical compositions.

On the other hand, for the prior art specimens, the drawing conditions included a die approach angle of 11°, an area reduction ratio to be selected from a 20-17% range and a wire drawing speed to be selected from a 30-500 m/min. range, with the above-described wire drawing direction set at about 1 (for habituating wires). Further, heat-treatment was carried out at 300-350° C. for 20 minutes.

The thus prepared specimens were subjected to Hunter's rotating bending fatigue test to determine fatigue strengths, while their lattice constants and lattice distorsions were determined by an X-ray diffraction method. Each specimen had lattice constants and lattice distorsions after wire drawing and after heat treatment, respectively, as show in Table 12 below.

TABLE 12

| | | After drawing | After heat treatment |
|---|---|---|---|
| Prior art specimen | Lattice constant (a) | 2.8665–2.8710 | 2.8665–2.8695 |
| | Lattice distorsion | 0.001a–0.0045a | >0.0015a |
| Inventive specimen | Lattice constant (a) | 2.8670–2.8710 | 2.8670–2.8705 |
| | Lattice distorsion | 0.0025a–0.0045a | 0.001a–0.002a |

Figure 27:
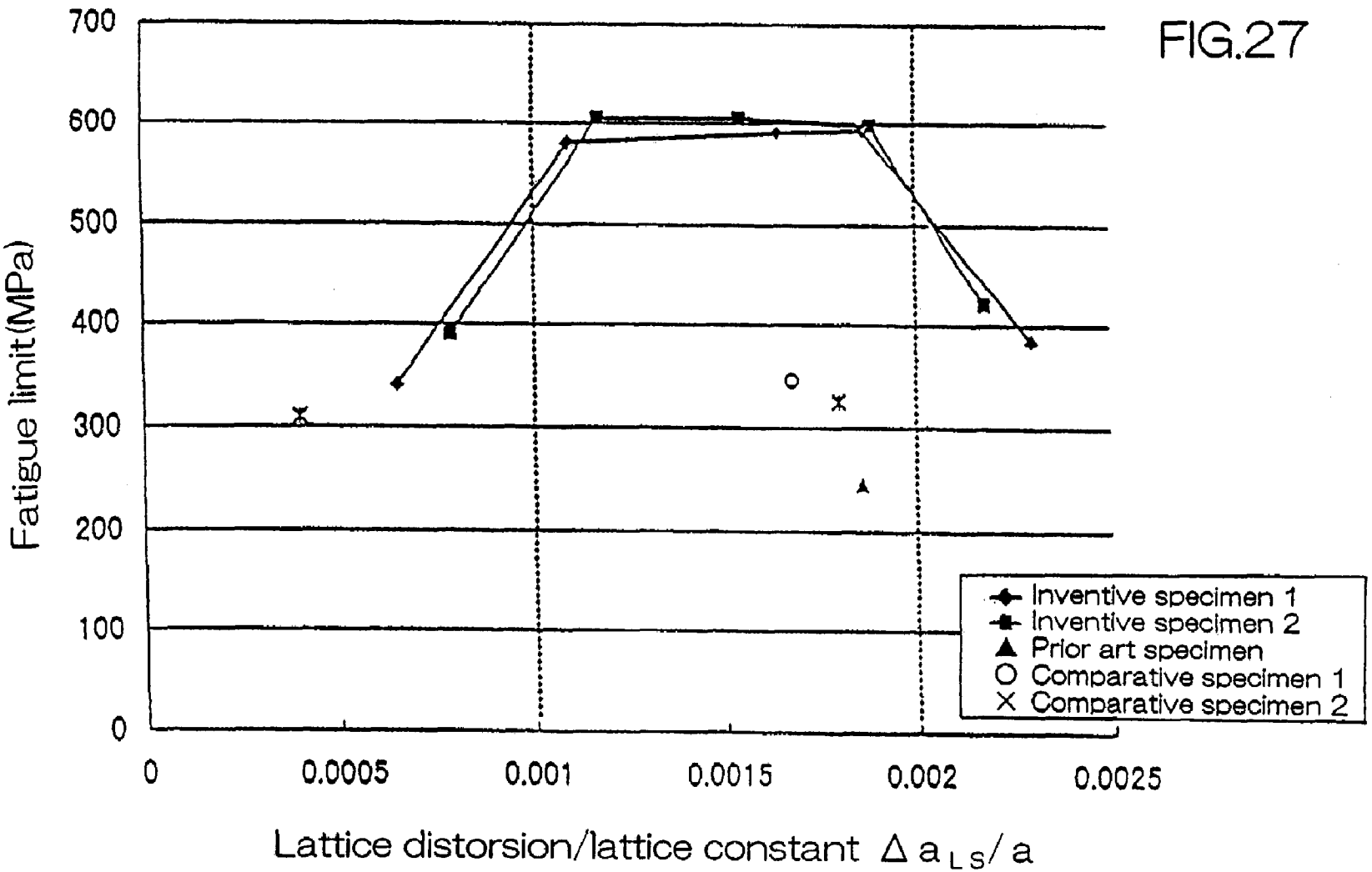
FIG. 27 is a graph showing a relation between lattice distorsion/lattice constant and fatigue limit for steel wires involving varied chemical compositions, drawing conditions and heat treatment conditions.

This result is given on the graph of FIG. 27 along with the result of the fatigue test. As can be seen from this graph, the inventive specimens 1 and 2 representing the steel wire of the present invention have a high fatigue limit and satisfactory fatigue properties with their lattice constant a and lattice distorsion $\Delta a_{LS}$ satisfying the formula $0.001\times a \leqq \Delta a_{LS} \leqq 0.002\times a$. In contrast, the comparative material 1 and 2 are inferior in fatigue properties. From this, it is clearly understood that it may be satisfactory if the lattice distorsion is in the ranges of: (1) 0.0025a-0.00.45a before heat treatment, namely, after cold working; and (2) 0.001a-0.002a after heat treatment.

EXPERIMENTAL EXAMPLE 4-2

Figure 28:
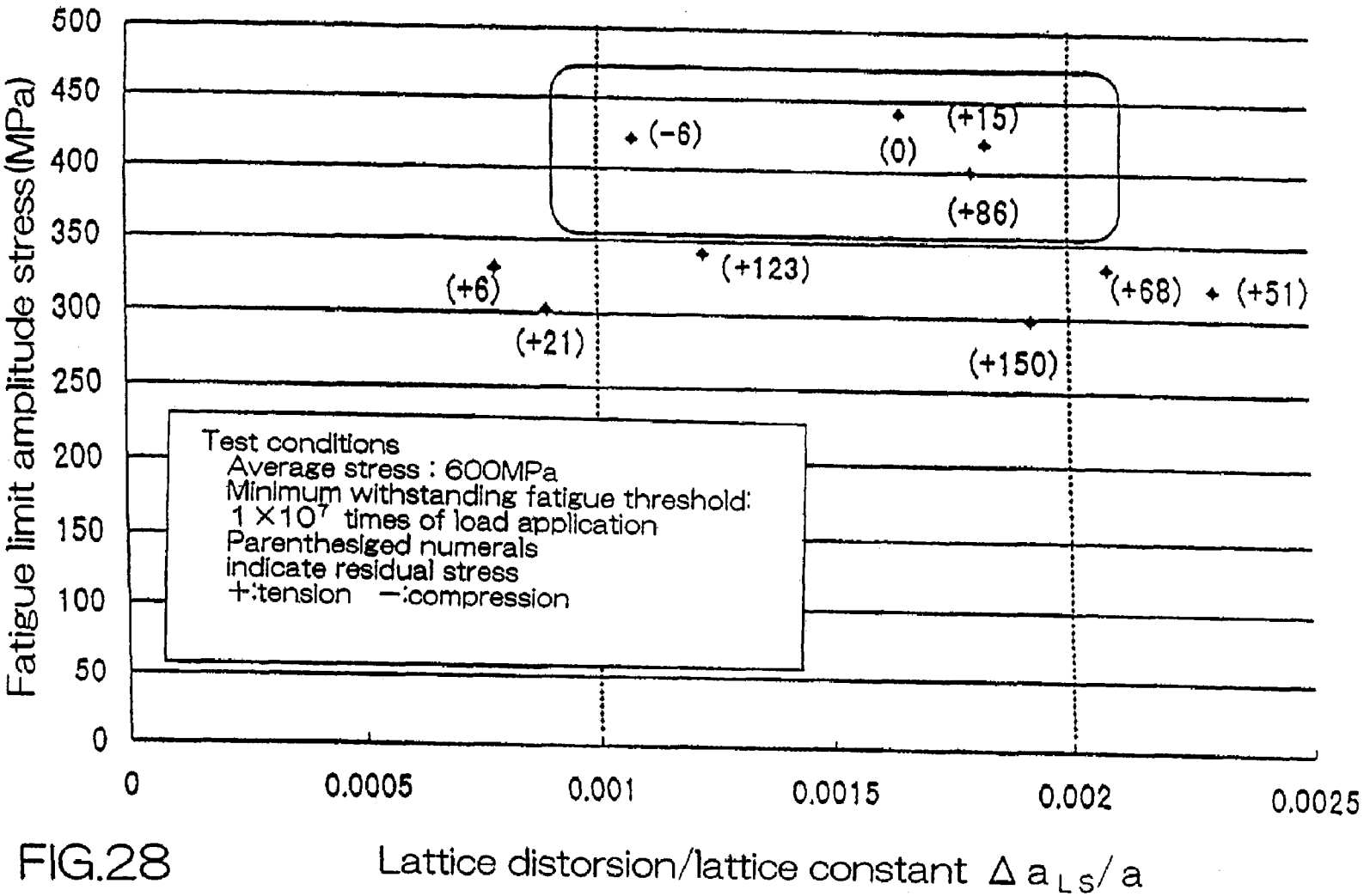
FIG. 28 is a graph showing a relation between lattice distorsion/lattice constant and fatigue limit in steel wires after being worked into coil springs.

The inventive specimens 1 were worked into wires of 1.6 mmϕ by repeating the same process steps as in the experimental example 4-1 up to the drawing step, and the resultant steel wires were worked into coil springs, followed by a fatigue test of the resultant coil springs. In this example, when the heat treatment temperature after coiling was changed in the range of 300° C.-450° C., the residual stress also changed from 280 MPa in tension to 30 MPa in compression. The spring specimens obtained under the respective heat treatment conditions were subjected to a fatigue test using a star fatigue tester, the result of which is shown on the graph of FIG. 28. According to the test result, the specimens exhibited a high fatigue limit in the presence of 100 MPa or smaller residual tensile stress or in the presence of compression stress with their lattice constant a and lattice distorsion $\Delta a_{LS}$ satisfying the formula $0.001\times a \leqq \Delta a_{LS} \leqq 0.002\times a$.

EXPERIMENTAL EXAMPLE 4-3

Steel species having chemical compositions of the above-described inventive specimens were rolled down to 11.5 mmϕ and immediately thereafter the rolled specimens were cooled in boiling water to undergo pearlite transformation. The resultant wire rods drawn down to steel wires of 4.22 mmϕ and 4.35 mmϕ, respectively, and then 4.22 wires as side wires (6 bundles) were stranded around a 4.35 mmϕ wire as center wire. Thereafter, the stranded wires were heat-treated at 350-450° C. to raise their yield points and thereby to obtain stranded PC steel wires. It is readily inferred that instead of cooling in boiling water a lead bath, salt bath, mist or blast air may be used to achieve almost the same effects.

Figure 29:
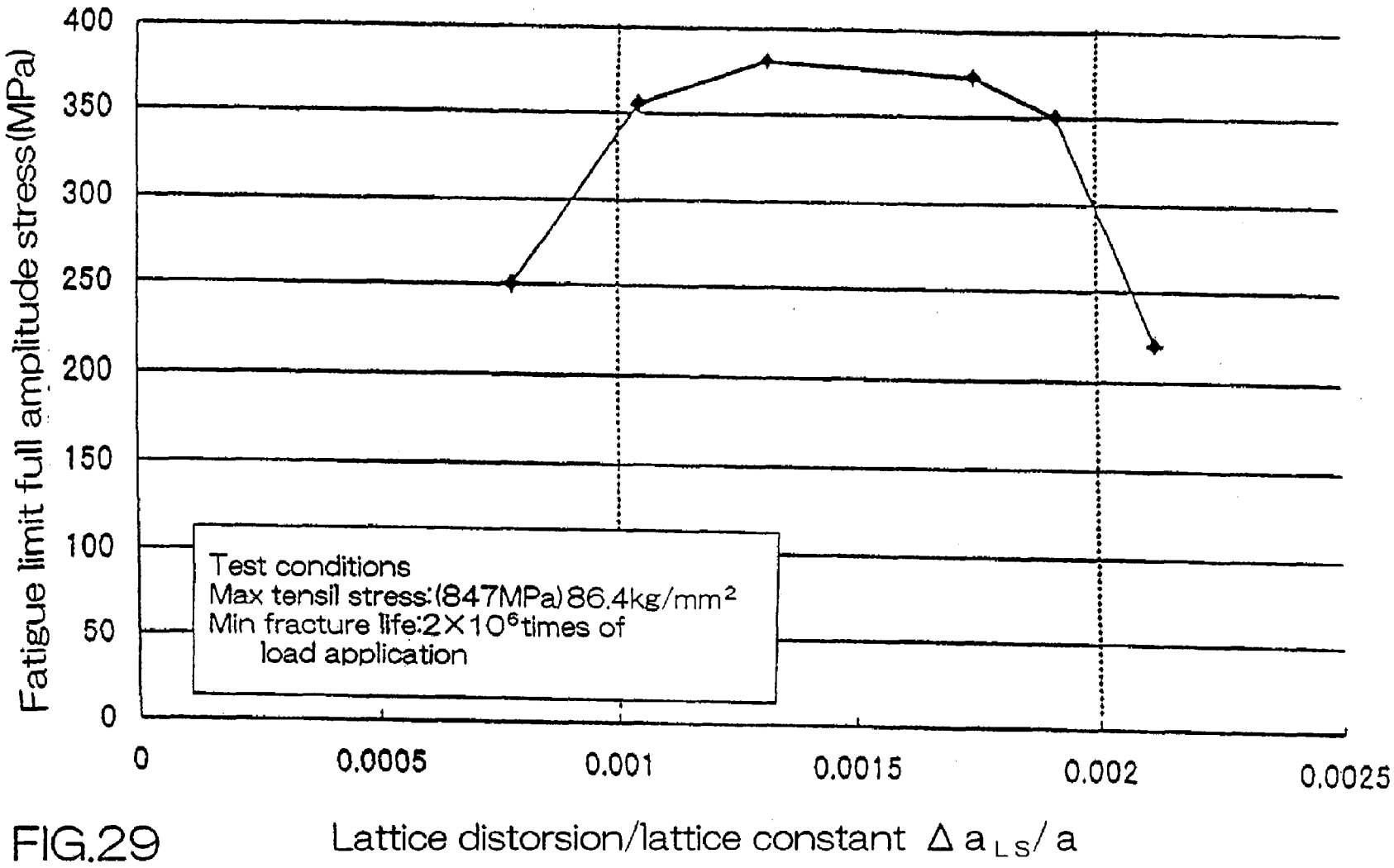
FIG. 29 is a graph showing a relation between lattice distorsion/lattice constant and full amplitude stress up to fatigue limit in steel wires after being worked into stranded PC steel wires.

In this example, the drawing conditions were same basically as those used in the foregoing experimental example 4-1 except for size. The thus prepared specimens of stranded PC steel wire were subjected to a tensile fatigue test. In the fatigue test, under a 86.4 kg/mm$^2$ load as maximum, a magnitude of full amplitude load (σA) up until a fracture occurrence was determined. The minimum fracture life was set at 2,000,000 times of load application. Like the experimental example 4-1, the lattice constant and lattice distorsion were also determined. The result is shown in FIG. 29.

In this example also, the steel wires based on the inventive specimens 1 representing a steel wires of the present invention withstood a large full amplitude load (σA) and exhibited satisfactory fatigue properties with their lattice constant and lattice distorsions $\Delta a_{LS}$ satisfying the formula $0.001\times a \leqq \Delta a_{LS} \leqq 0.002\times a$.

EXPERIMENTAL EXAMPLE 4-1

After patenting wire rods of 3.65 mmϕ obtained from materials having chemical compositions of the above-described inventive specimens 1, the patented wire rods were drawn with varied working ratios and heat-treated under varied conditions so that the fatigue strength could be determined under such varied conditions of working ratio and heat treatment. Except for wire size (working ratio), the conditions of fatigue test, drawing and heat treatment were the same as those used in the experimental example 4-1. For lattice constants $a_1$ and $a_2$ before and after heat treatment, respectively and lattice distorsions $\Delta a_{LS1}$ and $\Delta a_{LS2}$ also before and after heat treatment, respectively, a relations of fatigue properties versus these lattice constants is shown in FIG. 30.

Figure 30:
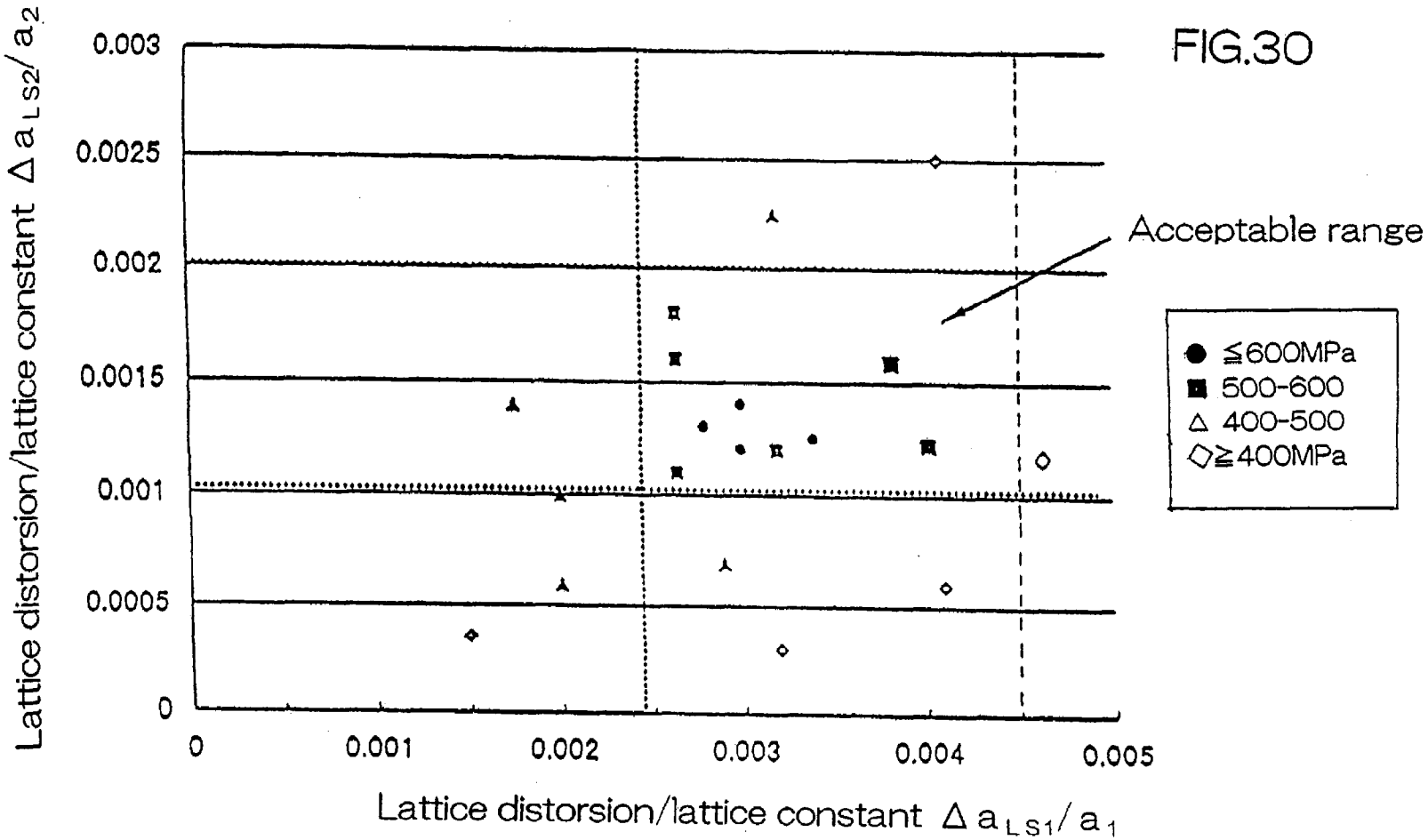
FIG. 30 is a graph showing a relation between lattice distorsion/lattice constant and fatigue limit in steel wires after drawing and in steel wires after heat treatment.

As clearly understood from the graph of FIG. 30, the steel wire can have satisfactory fatigue properties when its lattice constant $a_1$ and lattice distorsion $\Delta a_{LS}$ after drawing satisfy the formula $0.0025\times a_1 \leqq \Delta a_{LS1} \leqq 0.0045\times a_1$ and its lattice constant $a_2$ and lattice distorsion $\Delta a_{LS1}$ after the heat treatment satisfy the $0.001\times a_2 \leqq \Delta a_{LS2} \leqq 0.002\times a_2$.

INDUSTRIAL APPLICABILITY OF THE INVENTION

As fully described hereinbefore, the steel wire according to the present invention provided with a high heat resistance and a high fatigue resistance may be used for spring wires, stranded PC steel wires, control cables, steel cords, and parallel wires, etc. Particularly, the steel wire of the present invention is best suited for use in valve springs in automobile engines.

The invention claimed is:

1. A method of manufacturing a steel wire comprising the steps of: shaving a steel wire rod of pearlite structure containing 0.7-1.0 mass % of C and 0.5-1.5 mass % of Si, patenting the shaved wire rod, and drawing the patented wire rod, wherein said steel wire is produced without applying a quenching and tempering process, and the shaving is carried out to remove outer layers of the steel wire having a micro-Vickers hardness at least 50 lower than that of the inner portion of the steel wire.

2. The method of claim 1, characterized by further comprising the step of strain relief annealing at 350-450° C. after the wire drawing step.

3. A method of manufacturing a steel wire comprising the steps of:

cold-working a steel material of pearlite structure containing 0.7-1.0 mass % of C and 0.5-1.5 mass % of Si, so that the resultant steel wire has a lattice constant $a_1$ and lattice distortion $\Delta a_{LS1}$ satisfying the following formula (1) after the cold-working process:

$$0.0025\times a_1 \leqq \Delta a_{LS1} \leqq 0.0045\times a_1; \quad (1)$$

and heat-treating the resultant steel wire, so that the lattice constant $a_2$ and the lattice distortion $\Delta a_{LS2}$ thereof satisfy the following formula (2):

$$0.001\times a_2 \leqq \Delta a_{LS2} \leqq 0.002\times a_2; \quad (2)$$

wherein said steel wire is produced without applying a quenching and tempering process;

a reduction in area is limited in the range of 18 to 15% per one pass of cold-working;

the lattice constant $a_1$ is in the range of 2.8670 to 2.8710 Å; and the lattice constant $a_2$ is in the range of 2.8670 to 2.8705 Å.

* * * * *